US005442894A

United States Patent [19]

Ogata et al.

[11] Patent Number: 5,442,894

[45] Date of Patent: Aug. 22, 1995

[54] PACKAGING DEVICE

[75] Inventors: Taizo Ogata; Yuji Hanazawa, both of Chiba; Yasuo Iwata, Tokyo; Toshio Shigeta, Chiba, all of Japan

[73] Assignee: Tokyo Automatic Machinery Works, Ltd., Tokyo, Japan

[21] Appl. No.: 998,918

[22] Filed: Dec. 30, 1992

[30] Foreign Application Priority Data

| | | | |
|---|---|---|---|
| Jan. 28, 1992 | [JP] | Japan | 4-013331 |
| Jan. 28, 1992 | [JP] | Japan | 4-013332 |
| Jan. 28, 1992 | [JP] | Japan | 4-013333 |
| Jan. 28, 1992 | [JP] | Japan | 4-013338 |

[51] Int. Cl.[6] ..... B65B 11/28

[52] U.S. Cl. ..... 53/234

[58] Field of Search ..... 198/461, 470.1, 475.1, 198/476.1, 477.1, 579; 53/225, 233, 234

[56] References Cited

U.S. PATENT DOCUMENTS

| | | | |
|---|---|---|---|
| 3,827,545 | 8/1974 | Buhayer | 198/579 X |
| 3,987,605 | 10/1976 | Johnson | 53/234 |
| 4,518,075 | 5/1985 | Aykut et al. | 198/461 X |
| 4,823,536 | 4/1989 | Mansersigi et al. | 53/234 X |
| 4,866,912 | 9/1989 | Deutsch | 53/234 X |
| 4,918,901 | 4/1990 | Gamberini et al. | 53/234 |
| 4,999,970 | 3/1991 | Bamrungbhuet et al. . | |
| 5,003,755 | 4/1991 | Draghetti | 53/234 X |
| 5,046,258 | 9/1991 | Cahill et al. . | |

FOREIGN PATENT DOCUMENTS

| | | | |
|---|---|---|---|
| 0030359 | 6/1981 | European Pat. Off. . | |
| 509293 | 10/1992 | European Pat. Off. | 53/234 |
| 61-39251 | 9/1986 | Japan . | |
| 285109 | 3/1990 | Japan . | |
| 1086180 | 10/1967 | United Kingdom . | |
| 2003817 | 3/1979 | United Kingdom . | |
| 2164913 | 4/1986 | United Kingdom . | |
| 2195314 | 4/1988 | United Kingdom . | |
| 2206327 | 1/1989 | United Kingdom . | |

OTHER PUBLICATIONS

English Abstract of Japanese Patent No. 61-39251. Sep. 1986.

*Primary Examiner*—Linda Johnson

*Attorney, Agent, or Firm*—Sandler, Greenblum & Bernstein

[57] ABSTRACT

A packaging device wherein a thermoplastic packaging sheet is supplied to a peripheral part of a pocket opening of a winding wheel while a box-like item, transported into the pocket, is continuously transferred, the item being transported out of the pocket and delivered whereby the sheet is wound in a U-shape along the surface of the item, and both free ends of the sheet are folded, along the surface of the item while the item is continuously transferred, and then overlapped to thermally adhere to each other, wherein an applying wheel continuously rotating synchronously in a direction opposite to that of the winding wheel, is disposed on a downstream side of the winding wheel with each of the outer circumferences of the winding wheel and the applying wheel being provided with a plurality of pockets having the items transported therein, the winding and applying wheels, being equally spaced apart in a rotational direction and being continuously oppositely rotated in a synchronous manner, with both pockets being kept on a linear line over a predetermined segment across a delivery position where the pockets in the winding wheel and the applying wheel are opposite to each other in a linear line with pushers being utilized for pushing the items in the winding wheel pockets the applying wheel pocket, a sheet supplying mechanism supplying the sheet to the winding wheel outer circumference and a holding mechanism for temporarily holding the sheet around the opening of the winding wheel pocket.

12 Claims, 13 Drawing Sheets

PACKAGING DEVICE

BACKGROUND OF THE INVENTION

1. Field of the Invention

The present invention relates to a packaging device utilizing a thermoplastic packaging sheet such as cellophane or polypropylene or the like, for covering a box-like item containing cigarettes or the like, and more particularly a device in which the thermoplastic packaging sheet is supplied around some pockets of a winding wheel while the box-like items, transported in the pockets, are being continuously transferred. The box-like items are moved out of the pockets and delivered, whereby the packaging sheet is wound in a U-shape along a surface of the box-like item and both free ends of the packaging sheet are folded, along the surface of the box-like item while the delivered box-like item is being continuously transferred, overlapped to each other, and thermally adhered to each other.

2. Background and Material Information

Prior art pertaining to this kind of packaging device is disclosed in Laid-Open Japanese Patent No. HEI 2-85109, and shows a packaging device in which a plurality of pockets are equally spaced apart at an outer circumference of a continuously rotating winding wheel. A concave curved chain conveyor is wound in an annular form adjacent to a predetermined segment at an outer circumference of the winding wheel. A plurality of pockets are disposed in the chain belt at the same spacing as that of the installed pockets of the winding wheel, while a heater belt is wound on an annular form adjacent to a predetermined segment outside the chain conveyor. The chain conveyor and heater belt are moved in a synchronous manner with the rotational speed of the winding wheel at the same speed. The box-like item in the pockets are transferred in an arcuate form under a continuous rotation of the winding wheel, and the packaging sheet is held so as to cover the openings of the pockets during this arcuate transferring operation. Thereafter, each pocket of the winding wheel is oppositely faced against the pocket in the chain conveyor in a linear manner. The box-like item is transported out of the pocket of the winding wheel and delivered into the pocket of the chain conveyor, whereby the packaging sheet is wound along the surface of the box-like item in a U-shape and then both free ends of the packaging sheet, projecting from the pocket, are folded along an outer surface of the box-like item while being transported with the chain conveyor, overlapped with each other and the overlapped portions are abutted against the heater belt and thermally adhered to each other.

However, the prior art packaging device as described above has disadvantages in that the annular chain conveyor is bent in a concave form over a predetermined spacing around an outer circumference of the winding wheel in order to permit a positive delivery of the box-like item from the pocket of the winding wheel into the pocket of the chain conveyor. This increases the size of the chain conveyor positioned at a downstream side from a diametrical portion of the winding wheel, causing the entire device to be larger in size and its moving speed cannot be increased due to the structure of the chain conveyor. Thus the winding wheel cannot be rotated at high speed, with the result that the processing speed is limited and high speeds cannot be attained so that a large number of packagings may not be carried out within a short period of time.

In addition, the prior art packaging device has shortcomings due to a proportional relation between the moving speed of the chain conveyor and the contact time of the overlapped packaging sheet portions with the heater belt. If the rotational speed of the winding wheel or the moving speed of the chain conveyor is delayed below their normal speeds during energization of the device or at low speed operation thereof, for example, the contact time between the noted overlapped portions and the sealing heater is extended more than the normal contact time so as to lead to seizures. As the rotational speed of the winding wheel or the moving speed of the chain conveyor is increased, the speed difference is increased and the contact time between the overlapped portions and the heater belt may not be so increased.

In view of the aforesaid deficiencies in the prior art, it is an object of the present invention to interpose a compact barrel winding means, which can be operated at high speed, downstream from the winding wheel. It is another object of the present invention to keep the contact time, between the overlapped packaging sheet portions and the sealing heater, constant regardless of the variation of the rotational speed of the winding wheel.

SUMMARY OF THE INVENTION

A technical solution, achieved by the present invention in order to solve the aforesaid prior art deficiencies proposes that an applying wheel, continuously synchronously rotating in a direction opposite to the rotational direction of the winding wheel, is arranged in parallel near the downstream side of the winding wheel. Each of the outer circumferences of the winding wheel and the applying wheel is provided with a plurality of pockets with equal spacing, in a rotating direction and in an oscillatory manner, in which the box-like items are transported. The winding and applying wheels are continuously synchronously rotated relative to each other and opposite directions. Both pockets are kept on a linear line over a forward and rearward predetermined segment at a position for delivery where the pockets in the winding wheel and the pockets in the applying wheel are opposite to each other on the linear line. A pushing device is utilized for forcibly transferring the box-like items within the pockets of the winding wheel into the pockets of the applying wheel in such a way that these items may be moved out or moved in. A sheet supplying mechanism is provided for supplying packaging sheet to an outer circumference of the winding wheel and a holding mechanism is provided for temporarily holding the packaging sheet around openings of the pockets of the winding wheel.

Each of the outer circumferences of the winding wheel and the applying wheel, disposed in parallel with and near the winding wheel, is provided with a plurality of pockets at equal spacings into which the box-like items are inserted. The winding wheel and applying wheel are rotated synchronously and continuously in opposite directions to each other. Each of the pockets of the applying wheel is provided with a folding mechanism for folding both free ends of the packing sheet, projecting out of the pocket outwardly along an outer surface of the box-like item, and overlapping them over each other. A sealing heater contacts the overlapped portions of the folded packaging sheet for thermal adhesion. Further, a separating mechanism is provided for separating the sealing heater from the overlapped portions after a specified period of time, from a starting time of contact between the sealing heater and the overlapped portions of the packaging sheet.

According to the aforesaid technical solution, the present invention is operated such that the box-like items, fed into each of the pockets, are transferred in an arcuate form under a continuous rotation of the winding wheel. The packaging sheet, supplied from a sheet supplying mechanism during this arcuate transporting operation, is held to cover the openings of the pockets with a holding mechanism. Thereafter, each of the pockets in the winding wheel and the pockets of the applying wheel, opposite to the former, is oscillated over a predetermined segment after the pocket reaches a portion near a delivery position, whereby both of these pocket are kept on the linear line and at the same time a pushing device is projected and the box-like item is delivered into the pocket of the applying wheel.

As the applying wheel is continuously rotated, each of the pockets into which the box-like item is transported is moved in an arcuate manner and when the pocket reaches a predetermined angular position, a folding mechanism and a sealing heater are operated, whereby both free ends of the packaging sheet, projecting outwardly from the pocket, are folded along an outer surface of the box-like item and overlapped relative to each other. At the same time the sealing heater is in contact therewith, with the sealing heater being in contact with the overlapped portions, under operation of a separating mechanism, only for a specified period of time.

DETAILED DESCRIPTION OF THE PREFERRED EMBODIMENTS

Figure 1:
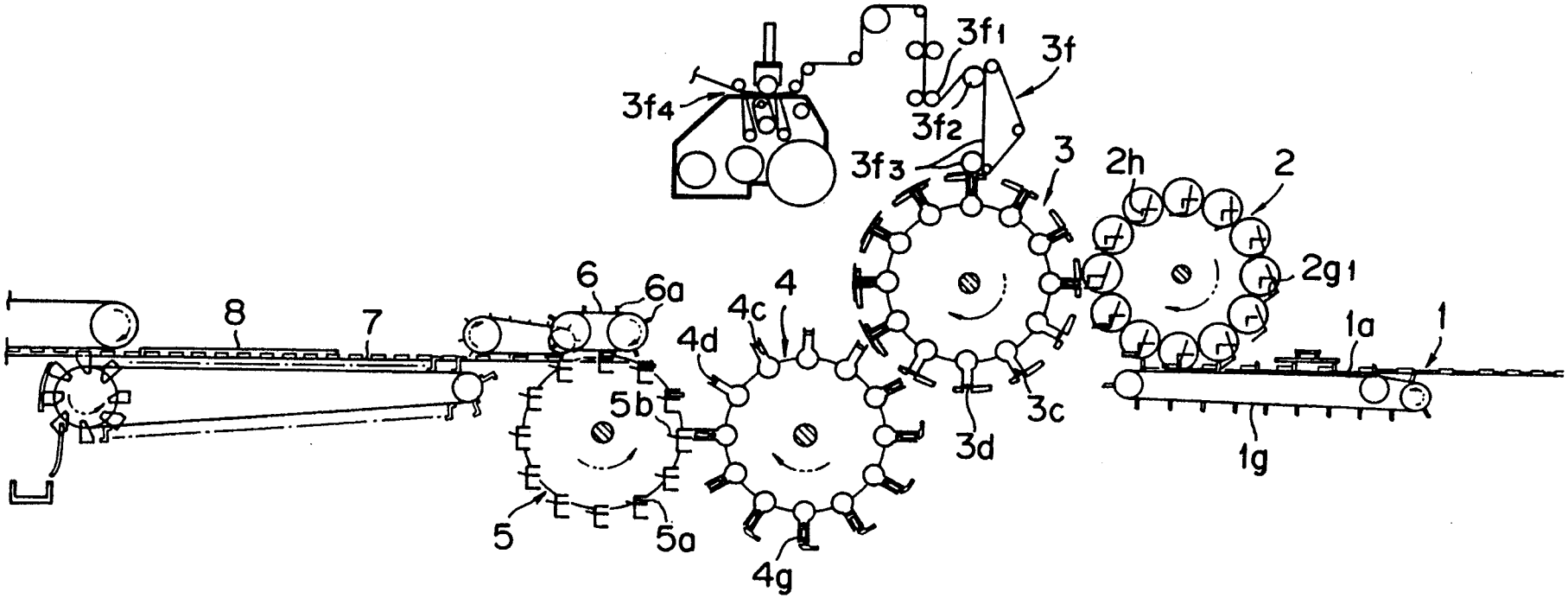
FIG. 1 is a front elevational view of longitudinal section for showing one preferred embodiment of the present invention.
Figure 2:
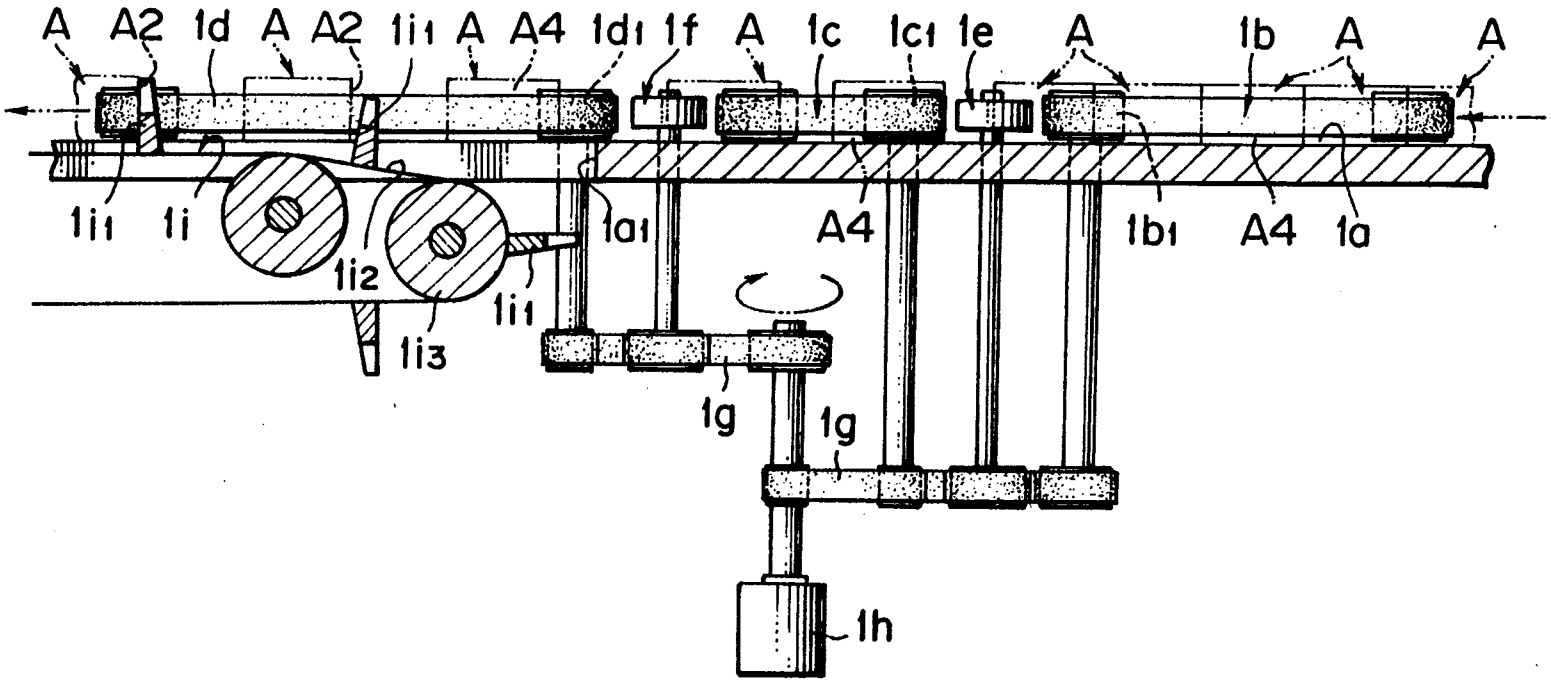
FIG. 2 is a partial enlarged front elevational view in longitudinal section for showing a transporting conveyor.
Figure 5:
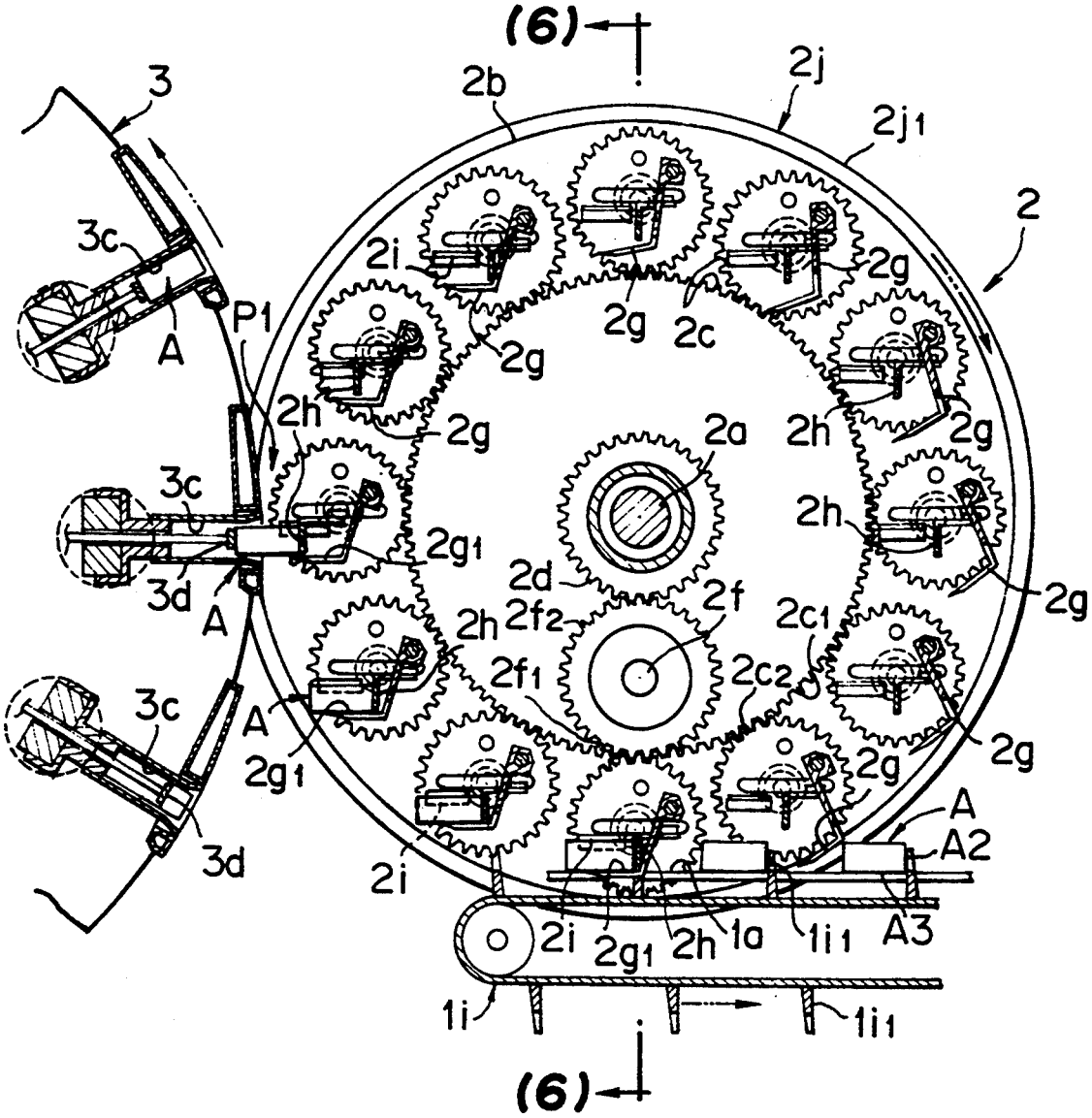
FIG. 5 is a partial enlarged front elevational view of a transferring wheel.
Figure 6:
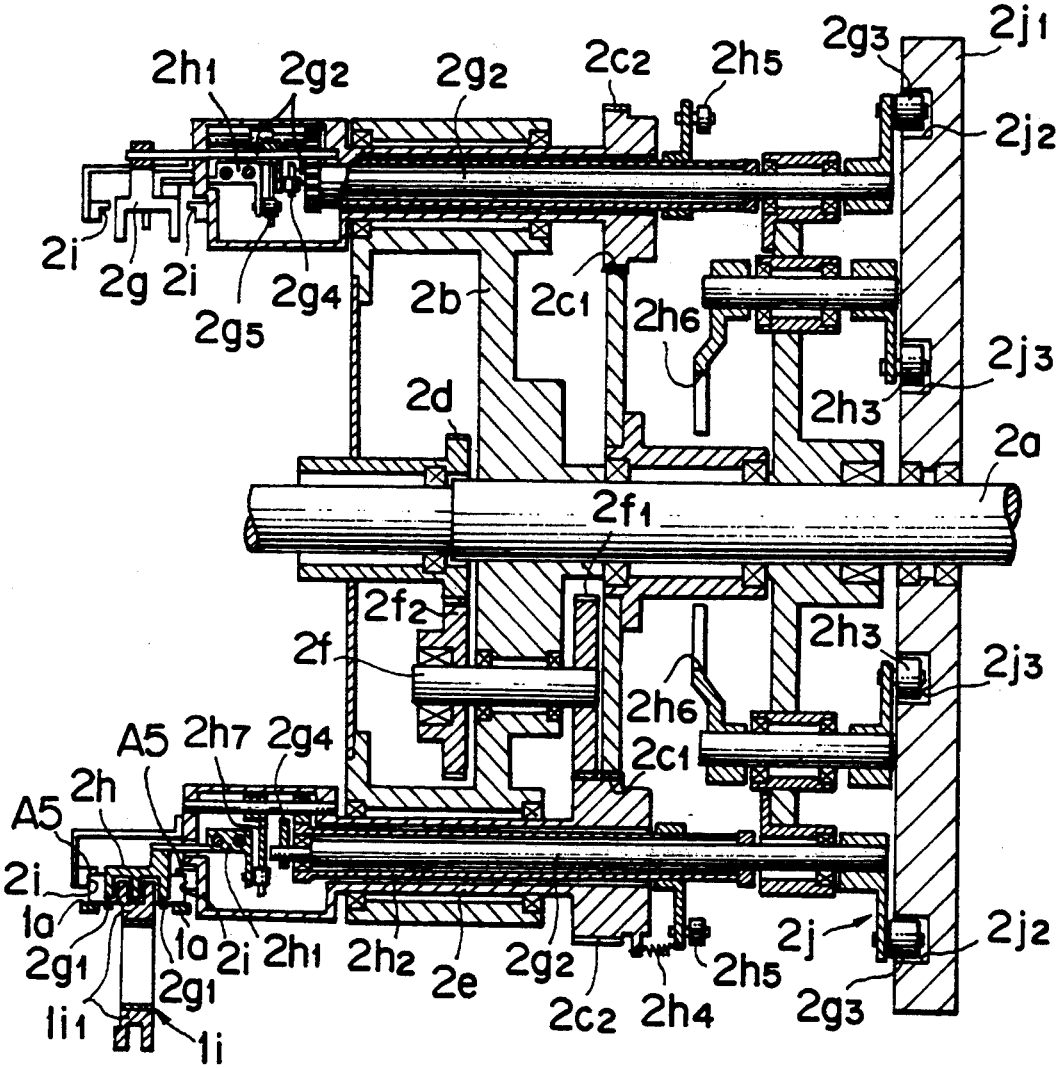
FIG. 6 is a front elevational view in longitudinal section taken along line 6—6 of FIG. 5.
Figure 7:
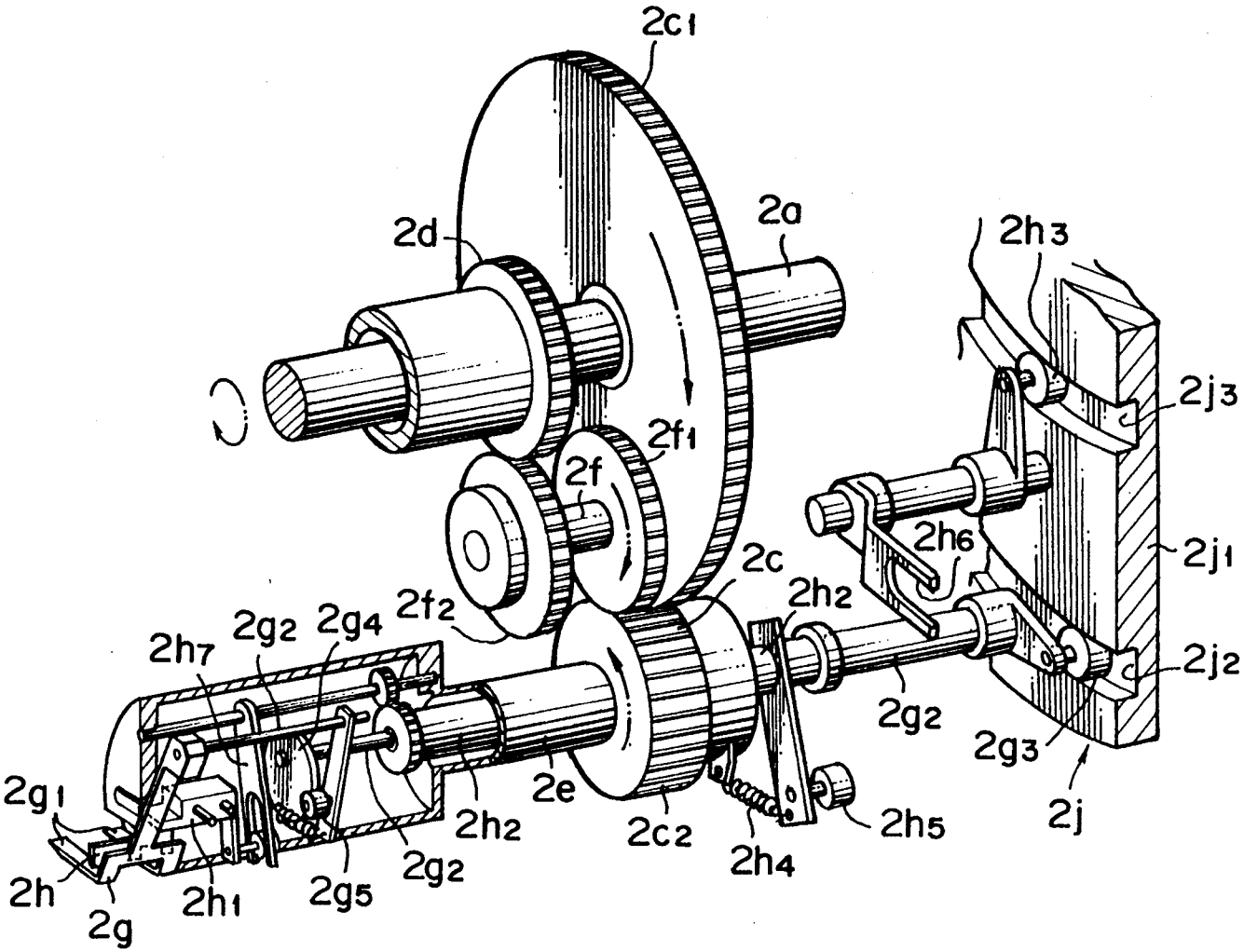
FIG. 7 is a partial enlarged perspective view for showing a simplified structure of a transferring wheel with a part thereof being broken away.
Figure 8:
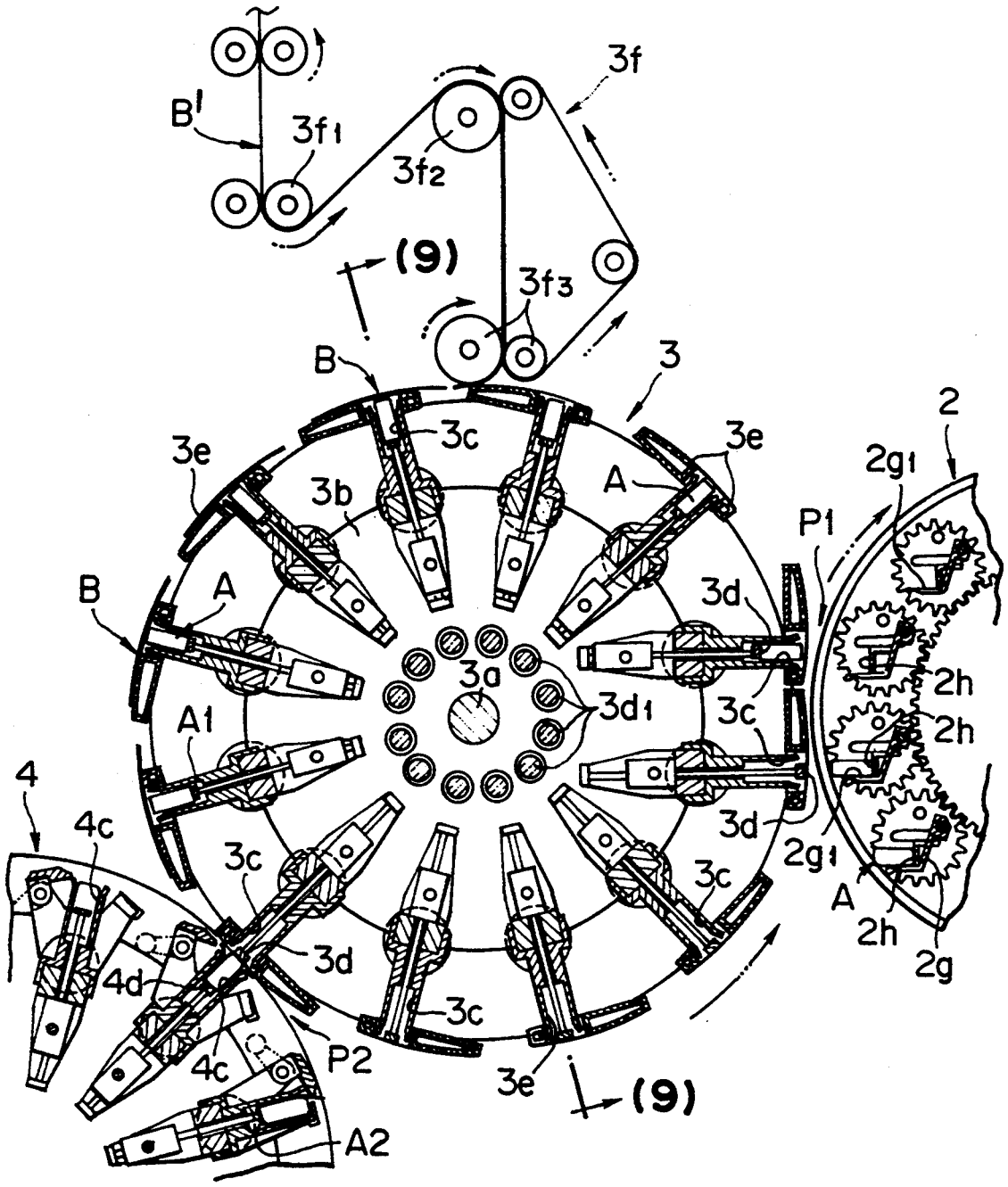
FIG. 8 is a partial enlarged front elevational view in longitudinal section for showing a winding wheel.
Figure 9:
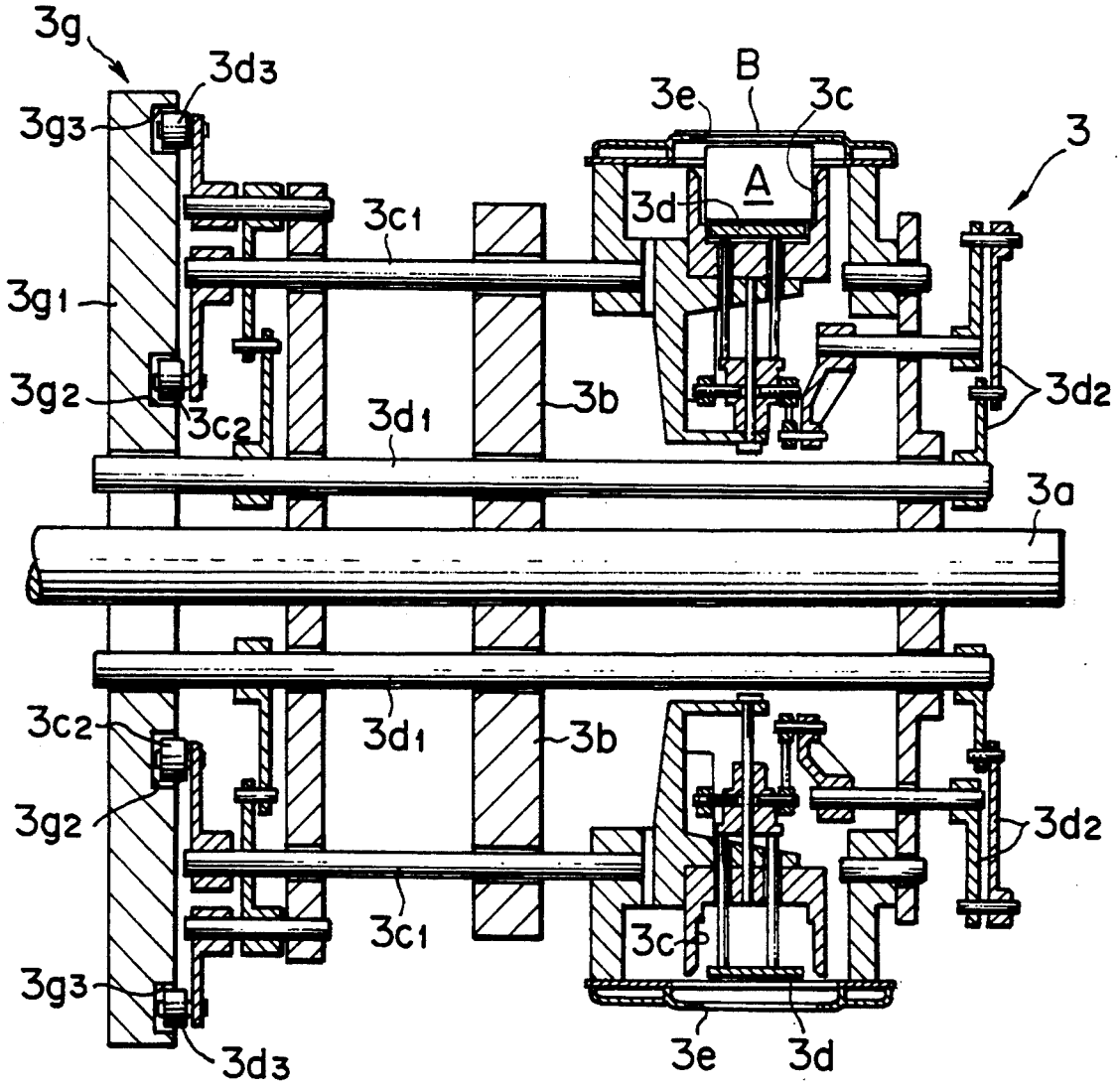
FIG. 9 is an enlarged front elevational view in longitudinal section taken along a line 9—9 of FIG. 8.
Figure 10:
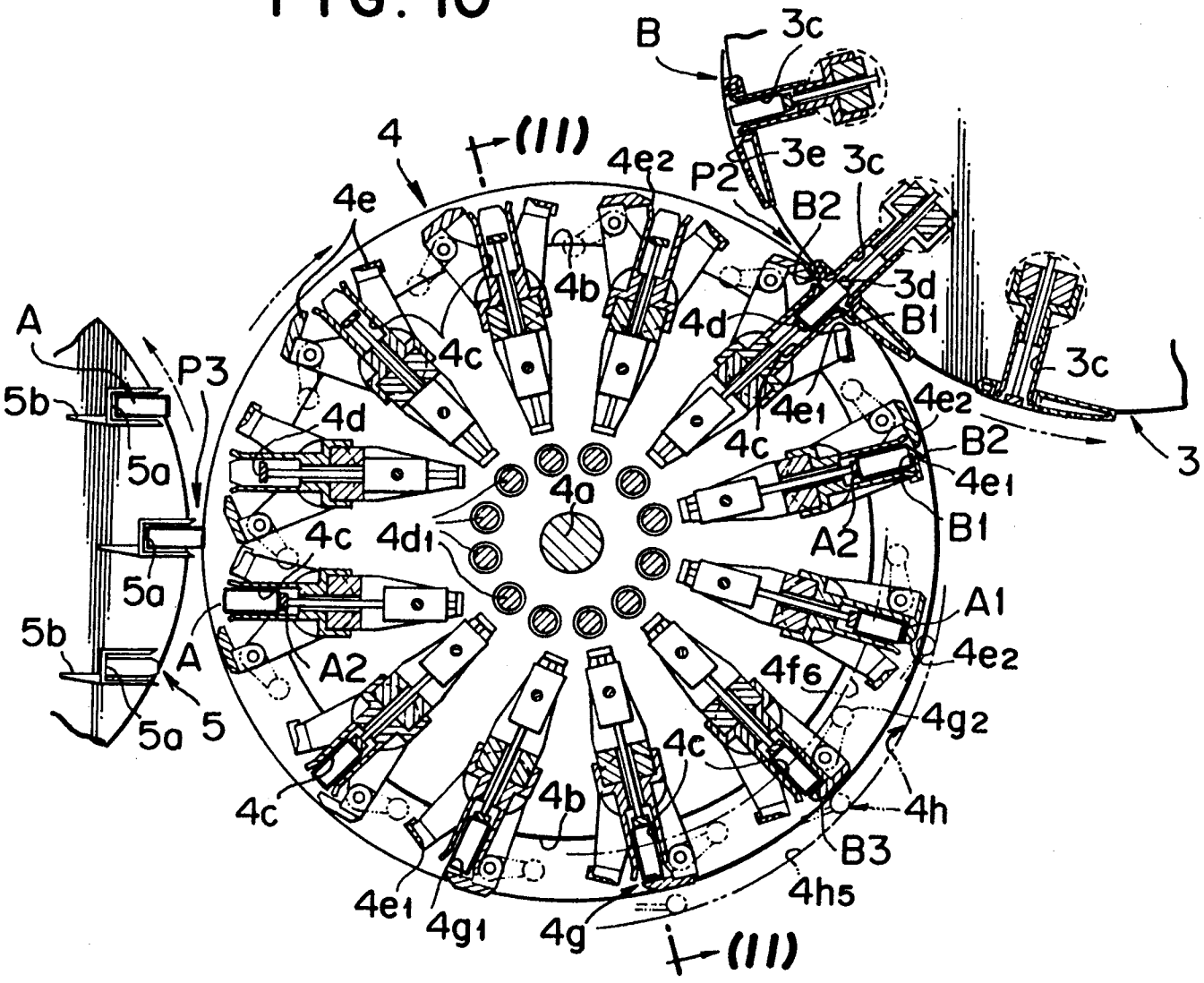
FIG. 10 is a partial enlarged front elevational view in longitudinal section for showing an applying wheel.
Figure 11:
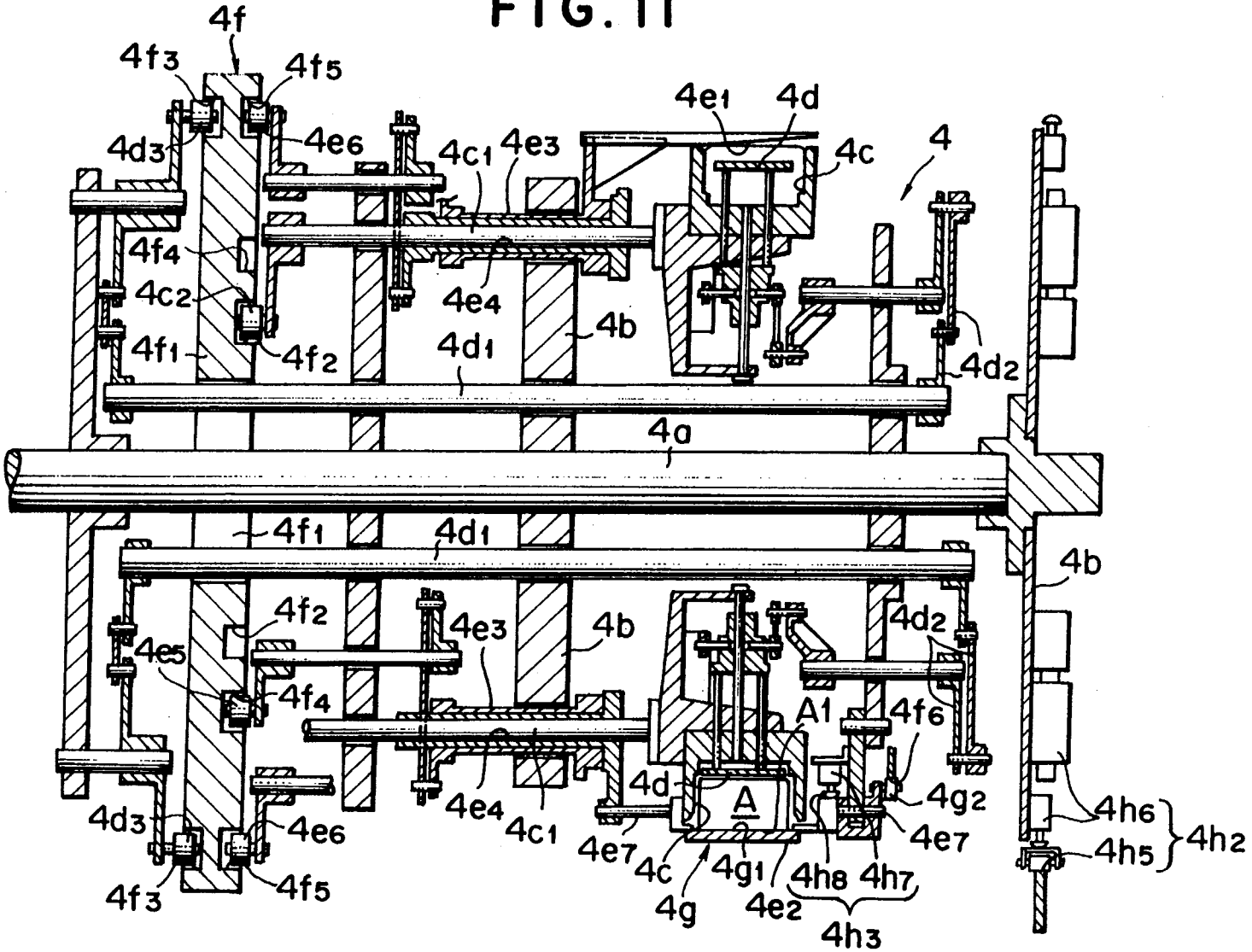
FIG. 11 is an enlarged side elevational view in longitudinal section taken along a line 11—11 of FIG. 10.

As shown in FIGS. 1, 2 and 5, the preferred embodiment of the present invention is constructed such that cigarettes, packaged as box-like items A are continuously supplied to an upstream end of a horizontal transporting conveyor 1 while being in contact with each other. Box-like items A are spaced apart by a predetermined distance during transportation by the transporting conveyor 1. These box-like items A are picked up one by one by a transferring wheel 2, transferred upwardly while being held in a horizontal state in an arcuate form and at the same time the box-like items A, while being transferred in an arcuate manner, are fed from the transferring wheel 2 into pockets 3*c* of a winding wheel 3, delivered from the pockets 3*c* of the winding wheel 3 into pockets 4*c* of an applying wheel 4, whereby a thermoplastic transparent film, such as cellophane or polypropylene or the like, acting as a packaging sheet B (FIG. 8), is wound along a surface of each of the box-like items A in a U-shaped form.

Transporting conveyor 1 is provided with a horizontal transferring passage la on which box-like items A are movably mounted. Three sets of opposed horizontal belt conveyors 1*b*, 1*b*; 1*c*, 1*c*; and 1*d*, 1*d*, are laterally disposed in a linear form in opposition to the right and left side surfaces A4, A4 of the box-like item A, respectively, as separating and supplying parts at an upstream side of the transferring passage 1*a*. The driving speed of the belt conveyors 1*c*, 1*c*, disposed midway between conveyor 1*b*, 1*b* and 1*d*, 1*d* is set faster than the driving speed of the belt conveyors 1*b*, 1*b* disposed at an upstream side. The driving speed of the belt conveyors 1*d*, 1*d* disposed at a downstream side is set faster than a driving speed of the intermediate belt conveyors 1*c*, 1*c*, and then each of a pair of feeding rollers, 1*e*, 1*e*, and 1*f*, 1*f* are disposed between these three sets of belt conveyors 1*b*, 1*b*; 1*c*, 1*c*; 1*d* and 1*d* in opposition to the right and left side surfaces A4, A4 of the box-like item A.

Each set of the feeding rollers 1*e*, 1*f* is disposed at a position where their outer circumferences $1e_1$ and $1f_1$ abut against both opposed side surfaces A4, A4 of the item A being transported. Driving shafts $1e_2$ and $1f_2$ are inserted into central portions of feeding rollers 1*e*, 1*f*, respectively and are connected to a driving source. Each of shafts $1e_2$ and $1f_2$ is always rotated in a transporting direction of the box-like item A, and at the same time one-way clutches $1e_3$, $1f_3$ are disposed between outer circumferences $1e_2$, $1f_2$, respectively.

One-way clutches $1e_3$, $1f_3$ have a cam or roller between the inner and outer circumferences thereof so as to transmit torque only or permit one rotation of the inner or outer circumferences in order to perform idling rotation in respect to the other rotation, so as to transmit a rotation of the driving shafts $1e_2$, $1f_2$ toward a transporting direction to the outer circumferences $1e_1$, $1f_1$. Rotation of the driving shafts $1e_2$, $1f_2$ toward the transporting direction is transmitted to the outer circumferences $1e_1$, $1f_1$ and a rotation of the outer circumferences $1e_1$, $1f_1$ toward the transporting direction is rotated idly in respect to the driving shafts $1e_2$, $1f_2$.

Thus, driving pulleys $1b_1$, $1b_1$; $1c_1$, $1c_1$; $1d_1$, $1d_1$, of the belt conveyors 1*b*, 1*b*; 1*c*, 1*c*; 1*d*, 1*d*, respectively, and the driving shafts $1e_2$, $1e_2$, $1f_2$, $1f_2$ of the feeding rollers 1*e*, 1*e*; 1*f*, 1*f*, respectively, are operatively connected to a driving source 1*h*, such as a motor, for example, with a transmitting member 1*g*, such as a belt being, wound alternatively wherein a rotation of the driving shafts $1e_2$, $1e_2$; $1f_2$, $1f_2$ of the one way clutches $1e_3$, $1e_3$; $1f_3$, $1f_3$ toward a transmitting direction is drivingly transmitted to each of the outer circumferences $1e_1$, $1e_1$; $1f_1$, $1f_1$, resulting in that the rotational speed of the outer circumferences $1e_1$, $1e_1$; $1f_1$, $1f_1$ is the same as that of the belt conveyors 1b, 1b; 1c, 1c, respectively.

A belt conveyor 1i, having pusher plates $1i_1$ abutting against the rear surface A2 of the box-like item A and equally spaced apart in a transporting direction, is laterally disposed along a through-pass hole $1a_1$ opened in the transferring passage 1a at a further downstream side of the belt conveyors 1d, 1d, wherein an upper surface of the belt $1i_2$ corresponding to the inlet side is inclined downwardly as it is directed to an upstream side and as a pulley $1i_3$, positioned at the upstream end, is rotated. The belt $1i_2$ is moved along its transporting direction and it is projected out of the transferring passage la after each of the pusher plates $1i_1$ is raised to a substantially vertical orientation.

The transferring wheel 2 is rotatably disposed in a vertical direction near an upper part of the downstream side of the transporting conveyor 1. A driving shaft 2a is disposed horizontally in a rightward or leftward direction perpendicular to a horizontal direction with the transporting conveyor I at its central part. Driving shaft 2a cooperatively connected to the driving source of the transporting conveyor 1, whereby transferring wheel 2 is continuously rotated in clockwise direction, as viewed from a front side, in a synchronous manner as its circumferential speed becomes substantially the same as the moving speed of the pushing conveyor 1i.

Driving shaft 2a is fixedly inserted into a central part of a disk 2b so as to cause the disk 2b to be cooperatively driven with the rotation of the driving shaft 2a and at the same time shaft 2a, is rotatably journalled relatively to a sun gear $2c_1$ of a planetary gear mechanism 2c and a fixed gear 2d, with fixed gear 2d being fixedly disposed without having any relation with the rotation of the driving shaft 2a.

At disk 2b, each of twelve hollow shafts 2e is rotatably supported in equally-spaced apart relation in parallel with the driving shaft 2a. Planetary gears $2c_2$, engaging with the sun gear $2c_1$ of the planetary gear mechanism 2c, are operatively disposed at an outer circumference of the base ends of these hollow shafts 2e. A cooperating shaft 2f is rotatably supported in parallel between the hollow shafts 2e and the driving shaft 2a, and has fixedly attached thereto a cooperating gear $2f_1$ which engages with one of the planetary gears $2c_2$. Driving gear $2f_2$, engaging with the fixed gear 2d, is cooperatively journalled at an outer circumference of the cooperating shaft 2f.

Accordingly, driving shaft 2a causes the transferring wheel 2 to be rotated in a clockwise direction as viewed from a front side thereof, whereby the disk 2b is rotated in a clockwise direction, with hollow shafts 2e being rotated in the clockwise direction and at the same time driving gear $2f_2$ is freely rotated around fixed gear 2d. Cooperating shaft 2f and the cooperating gear $2f_1$ are rotated in a clockwise direction, whereby the planetary gears $2c_2$ of the planetary gear mechanism 2c are freely rotated in a counterclockwise direction, as viewed from a front side, and the relative positions of the twelve hollow shafts 2e are kept at a predetermined angle without having any relation with the rotational position of transferring wheel 2.

At the extreme ends of the hollow shafts 23 are disposed holding claws 2g acting against the rear surface A2 and the bottom surface A3 of the box-like item A being horizontally fed by the pusher conveyor 1i while being moved toward or away from the transporting rail of transporting conveyor 1. Also disposed at the extreme ends of hollow shafts 2e are pushers 2h near holding claws 2g which act against the rear surface A2 of the box-like item A, with holding guides 2i opposing mounting surface $2g_1$ formed in the lower parts of the holding claws 2g.

Holding claws 2g are formed in a substantial L-shape, as viewed from a front side, in which the mounting surfaces $2g_1$ are divided into two segments in a positional relation not in contact with the downstream ends of the transferring passages 1a, 1a and separated in a rightward or leftward direction of the transporting conveyor 1 in a transporting direction. The mounting surfaces $2g_1$, $2g_1$ at the lower parts are supported in an oscillating manner in a transporting direction and an opposing direction. The rotating shafts $2g_2$ are cooperatively disposed at the upper end of wheel 2 each are rotatably supported within the hollow shafts 2e, with rotating shafts $2g_2$ being cooperatively connected with control cam 2j, to be described later.

Pushers 2h are disposed in such a positional relation as one in which they may not be abutted against the pusher plates $1i_1$ of the pusher conveyor 1i and the mounting surfaces $2g_1$, $2g_1$ of the holding claws 2g in a transporting direction. Rotating cylinders $2h_2$ are reciprocally supported in a transporting direction and an opposing direction against the extremity ends of the hollow shafts 2e operatively connected with supporting and moving part $2h_1$ rotatably supported in the hollow shafts 2e and at the same time the rotating cylinders $2h_2$ are operatively connected with the control cam 2j, to be described later.

The holding guides 2i are fixed and disposed between the mounting surfaces $2g_1$, $2g_1$ of the holding claws 2g and are oscillated in a transporting direction in a horizontal state with respect to the extremity ends of the hollow shafts 2e while being spaced apart by a distance corresponding to the vertical height of the box-like item A. Guides 2i are formed to have a shape to be slidably fitted, in a transporting direction, to the right and left edge corners A5, A5 at the upper surface at box-like item A, placed on the mounting surfaces $2g_1$, $2g_1$.

Control cam 2j is constructed such that fixed cam plate $2j_1$, fixed and disposed in spaced-apart and parallel with the transferring wheel 2, has a grooved cam $2j_2$ for controlling positions of the holding claws 2g to which rotating shafts $2g_2$ of the holding claws 2g are engaged through a driven roller $2g_3$. Control cam 2j also has grooved cam $2j_3$ for controlling a position of the pushers 2h to which the rotating cylinder $2h_2$, of the pushers 2h are engaged through a driven roller $2h_3$, with pushers 2h being formed annularly and being concave in shape. Parts of the rotating shafts $2g_2$ of the holding claws 2g are divided and include an eccentric cam $2g_4$ having cam roller $2g_5$ always abutted thereagainst.

In addition, the rotating cylinders $2h_2$, of the pushers 2h are operatively interconnected with hollow shafts 2e through resilient members, such as springs $2h_4$, for example. Projections $2h_5$ and concave portions $2h_6$ cooperate with each other at a predetermined position and are cooperatively disposed, respectively, at each of the base ends of the rotating cylinders $2h_2$, and the driven rollers $2h_3$. At the same time, oscillating levers $2h_7$ are operatively disposed at the extremity ends of the rotating cylinders $2h_2$ and further operatively interconnected with supporting and moving parts $2h_1$ of pushers $2h$.

Control cam $2j$ is operated such that, as driving shaft $2a$ is rotated, the holding claws $2g$ and the pushers $2h$ are rotated in a clockwise direction and at the same time each of the driven rollers $2g_3$, $2h_3$ is moved along the grooved cam $2j_2$, $2j_3$, respectively of fixed cam plate $2j_1$. The relative position of the driven rollers $2g_3$ is moved, thereby the rotating shafts $2g_2$ and the eccentric cams $2g_4$ are rotated, as each of the holding claws $2g$ reaches a predetermined angular position, with an angle corresponding to about the 10 o'clock position of the transferring wheel 2 in the preferred embodiment, and is moved toward an angle corresponding to about the 4 o'clock position through the upper limit position of the transferring wheel 2. The mounting surfaces $2g_1$, $2g_1$ are oscillated around the rotating shaft $2g_2$ in a direction opposite to the transporting direction and inclined downwardly. Thereafter, when control cam $2j$ reaches an angle corresponding to about 5 o'clock and moves toward an angle corresponding to about 6 o'clock i.e., the lower limit position of the transferring wheel. Mounting surfaces $2g_2$, $2g_1$ slide around the rotating shaft $2g_2$ toward the transporting direction to attain a horizontal state and subsequently the mounting surfaces $2g_1$, $2_{g1}$ remain in a horizontal state until shaft $2g_2$ reaches an angle corresponding to about 10 o'clock.

In addition, as relative positions of the driven rollers $2h_3$ are moved, each of the projections $2h_5$ and the concave portions $2h_6$ make control with each other only for a predetermined segment. Hollow shafts $2e$ and the rotating cylinders $2h_2$ normally operate cooperatively to keep these relative positions at a predetermined angle without any receiving any rotational position of the transferring wheel 2, resulting in that, although the supporting and moving parts $2h_1$ and the pushers $2h$ are not moved, each of the pushers $2h$ reaches a predetermined angular position, namely an angle corresponding to about the 8:30 o'clock position in the transferring wheel 2 in the preferred embodiment. The projections $2h_5$ and the concave parts $2h_6$ make contact with each other and as each of the pushers $2h$ passes through a delivery position P1 (FIG. 8), pockets $3c$ of the winding wheel 3, to be described later, reach toward an angle corresponding to about 9:30 o'clock. The resilient member $2h_4$ are extended to cause the oscillating lever $2h_7$ to be oscillated in a transporting direction, thereby activating the supporting and moving parts $2h_1$ and the pushers $2h$.

After this operation, as control cam $2j$ reaches toward an angle which corresponds to about 10:30 o'clock, it shortens the resilient members $2h_4$ to cause the oscillating lever $2h_7$ to be oscillated in counter-transporting direction, whereby the supporting and moving parts $2h_1$ and the pushers $2h$ are moved down, and subsequently the supporting and moving parts $2h_1$ and the pushers $2h$ are held at their moving-down positions until the interconnection between the projections until the interconnection between the projections $2h_5$ and the concave parts $2h_6$ is concluded and they reach an angle corresponding to about 8:30 o'clock.

Winding wheel 3 is disposed near a downstream side of the transferring wheel 2 and is further rotatably arranged in a vertical direction. Driving shaft $3a$, acting as center of rotation, is disposed in a rightward or leftward direction in a horizontal state, with driving shaft $3a$ being operatively connected with the driving source of the transferring wheel 2, whereby the winding wheel 3 is continuously rotated synchronously in a counterclockwise direction, as viewed from a front side, in such a way that its peripheral speed becomes substantially equal to the peripheral speed of the transferring wheel 2.

Driving shaft $3a$ is rotatably affixed through the center of the disk $3b$ to cause disk $3b$ to rotate with driving shaft $3a$, which each of twelve driving shafts $3c_1$ being rotatably supported in equal spaced apart relation around the outer circumference of the disk $3b$ in parallel with the driving shaft 3. At the same time, each of the pockets $3c$ is fixed to an outer end of each driving shaft $3c_1$ in a radial orientation so that the center lines thereof pass through the center of driving shaft $3a$. Pockets $3c$ are supported in an oscillating manner via rotation of driving shafts $3c_1$, ahead or radially in front of each one of twelve rotating shafts $3d_1$ associated with pushers $3d$ to be described later wherein each of the shafts $3d_1$ is rotatably supported in parallel in equal-spaced apart relation in a circumferential direction.

Pockets $3c$ have the form of a box-shape having substantially the same size as the outer shape and size of the box-like item A opened at its outer surface. Pushers $3d$ are disposed in pockets $3c$ in a radial direction of the winding wheel 3 in such a way that they may be projected out or retracted. A holding mechanism $3e$ composed of a suction surface, for example, is disposed at the circumference of the opening and packaging sheet B, continuously supplied from the sheet supplying mechanism $3f$, to be described later, is temporarily sucked and held so as to cover the opening of each of pockets $3c$.

Pushers $3d$ are disposed in opposition to the inner surfaces A1 of the box-like items A transported into the pockets $3c$ and cooperatively interconnected with rotating shafts $3d_1$ through links $3d_2$. The driving shafts $3c_1$ of pockets $3c$, and rotating shafts $3d_1$ of the pushers $3d$, are operatively interconnected with control cam $3g$, to be described later.

Control cam $3g$, spaced apart from but parallel with winding wheel 3, is constructed such that the cam plate $3g_1$ is fixed and disposed to cam $3g$ and has a grooved cam $3g_2$ for controlling a position of each of the pockets $3c$ with which the driving shafts $3c_1$ of the pockets $3c$ are engaged through driven rollers $3c_2$. A grooved cam $3g_3$, with which rotating shafts $3d_1$ of pushers $3d$ are engaged via driven rollers $3d_3$, is used for controlling the position of each of the pushers $3d$.

Control cam $3g$ is constructed such that as driving shaft $3a$ is rotated, pockets $3c$ and pushers $3d$ are rotated in a counterclockwise direction. As each of the driven rollers $3c_2$, $3d_3$ is moved along the grooved cams $3g_2$, $3g_3$ of the cam plate $3g_1$, the relative positions of the driven rollers $3c_2$ are moved, thereby rotating shafts $3c_1$. Each of pockets $3c$ is oscillated until it reaches the predetermined spacing of delivery position P1 opposing on a linear line against the mounting surfaces $2g_1$, $2g_1$ of the transferring wheel 2, i.e., at an angle corresponding to about the 3:30 o'clock position of the winding wheel 3, in the preferred embodiment, and reaches an angle corresponding to about the 2:30 o'clock position and it is kept on a linear line with the mounting surfaces $2g_1$, $2g_1$ of transferring wheel 2.

Thereafter, each of pockets $3c$ is oscillated until it reaches a predetermined spacing across a delivery position P2 where each of the pockets $3c$ opposes on a linear line, a pocket $4c$ of the applying wheel 4 to be described later, at an angle corresponding to about the 8 o'clock position of the winding wheel 3 until it reaches an angle corresponding to about the 7:30 o'clock position, in the preferred embodiment, and then each of the pockets, 3c is kept on a linear line with the pocket 4c of applying wheel 4.

In addition, the relative positions of the driven rollers $3d_3$ are moved to cause the rotating shafts $3d_1$ to be rotated, with each of pockets 3c reaching a predetermined spacing across the delivering position P2 opposed on a linear line to the pockets 4c of the applying wheel 4, at an angle corresponding to about the 8 o'clock position of the winding wheel 3, in the preferred embodiment, and moves toward an angle corresponding to about the 7 o'clock position, with pushers 3d being cooperatively pushed in response to a retraction of the pushers 4d of the applying wheel 4. Each of the pockets 3c reaches a predetermined spacing across the delivery position P1 opposed on a linear line to the mounting surfaces $2g_1$, $2g_1$ of the transferring wheel 2, as required, and an angle corresponding to about the 3:30 o'clock position of the winding wheel 3, then moves toward an angle corresponding to about the 2:30 o'clock position. Pushers 3d are cooperatively moved in response to the projecting movement of the pushers 2h of the transferring wheel 2 and they are retracted while being abutted against the inner surface A1 of the box-like item A to be transported therein.

The outer circumference of the winding wheel 3 is provided with a sheet supplying mechanism 3f for continuously supplying the packaging sheet B. Sheet supplying mechanism 3f has a control delivery passage B' for supplying the packaging sheet B toward the rotating passage from the sheet supplying source (not shown) toward the rotating passage of the pockets 3c of winding wheel 3. Mechanism 3f also includes a delivery part $3f_1$, for drawing the packaging sheet B at a slower speed than the peripheral speed in cooperation with the driving source of the winding wheel 3 and a cutter $3f_2$ for cutting the packaging sheet B into predetermined lengths toward the delivery direction. Mechanism 3f further includes a transferring part $3f_3$, for transferring the cut packaging sheet B toward the rotating passage of the pockets 3c at the same speed as its peripheral speed and a printer $3f_4$ (FIG. 1) for instantaneously printing information such as a manufacturing date, as may be required.

Applying wheel 4 is disposed on a downstream side of the winding wheel 3 at a downward slant angle of 45° rotatably in a vertical direction, with a driving shaft 4a, acting as a rotational center, being arranged in a horizontal direction in a rightward or a leftward direction. Driving shaft 4a is operatively interconnected with driving source of the applying wheel 3 and the applying wheel 4 is continuously rotated in a clockwise direction as viewed from a front side synchronously in such a way that its peripheral speed becomes substantially the same as that of applying wheel 3.

Driving shaft 4a is fixedly inserted through a center of the disk 4b to cause the disk 4b to rotate with driving shaft 4a with each of twelve driving shafts $4c_1$ being equally spaced apart and around the outer periphery of the disk 4b and rotatably supported in parallel with the driving shaft 4a. At the same time, each one of pockets 4c is radially fixed to an outer end of each rotating shafts $4c_1$ so that the center lines thereof pass through the center of the driving shaft 4a. Pockets 4c are supported in an oscillatory manner via rotation of the driving shafts $4c_1$. Each one of twelve rotating shafts 4d, associated with pushers 4d, which will be described later, is equally spaced apart in a peripheral direction and rotatably supported in parallel with driving shaft 4a.

Pockets 4c have the form of a box-like shape in which their outer surfaces are substantially of the same size as the outer size of box-like item A. Pushers 4d are disposed therein in a radial direction of the applying wheel 4 in such a way that they may be projected out or retracted, and the peripheral part of the opening, of pushers 4d is provided with folding claws $4e_1$ and folding pieces $4e_2$ which constitute the folding mechanism 4e in such a way as they may be moved toward or away from the outer surface A1 of the box-like item A transported into each of the pockets 4c while being opposite thereto.

Pushers 4d are disposed in opposition to the inner surfaces A2 of the box-like items A being transported into pockets 4a, and operatively interconnected with rotating shafts $4d_1$ through links $4d_2$. Each of rotating shafts $4c_1$ of the pockets 4c and the rotating shafts $4d_1$ of the pushers 4d is operatively interconnected to control cam 4f, to be described later.

Folding claws $4e_1$ and folding pieces $4e_2$ are disposed in opposition to each of both free ends B1, B2 of the packaging sheet B projecting outwardly from pockets 4c. Folding claws $4e_1$ are operatively connected with hollow shafts $4e_3$ rotatably disposed at outer circumferences of the rotating shafts $4c_1$ to which the pockets 4c are fixed. Folding pieces $4e_2$ are operatively connected with rotating cylinders $4e_4$ rotatably arranged between the outer circumference of the rotating shafts $4c_1$ and the inner circumference of hollow shaft $4e_3$ of the folding claws $4e_1$. The rotating cylinders $4e_4$ of the folding pieces 4e are also operatively connected with control cam 4f.

Control cam 4f, spaced apart from but parallel with applying wheel 4, is constructed such that cam plate $4f_1$ is fixed and disposed to cam 4f and has a grooved cam $4f_2$ for controlling the positions of the pockets 4c with which the rotating shafts $4c_1$ of the pockets 4c are engaged through the driven rollers $4c_2$. A grooved cam $4f_3$, with which the rotating shafts $4d_1$ of the pushers 4d are engaged with driven rollers 4d, is used for controlling the position 6E the pushers 4d. A grooved cam $4f_4$, with which the hollow shafts $4e_3$ of the folding claws $4e_1$ are engaged through the driven rollers $4e_5$ and a fixed cam $4f_6$, is used for controlling positions of the folding claws $4e_6$. Grooved cam $4f_5$, used for controlling positions of the folding pieces $4e_2$ to which the rotating cylinders $4e_4$ of the folding pieces $4e_2$ are engaged through the driven rollers $4e_6$, is formed in an annular form and shaped in a concave manner and at the same time fixed cam $4f_6$ is vertically disposed in opposition to the driven rollers $4g_2$ of sealing heaters 4g, to be described later.

Control cam 4f is operated such that, as the driving shaft 4a is rotated the pockets 4c, pushers 4d, folding claws $4e_1$ and folding pieces $4e_2$ are rotated in a clockwise direction and at the same time the driven rollers $4c_2$, $4d_3$, $4e_5$, and $4e_6$ are moved along the grooved cams $4f_2$, $4f_3$, $4f_4$, $4f_5$ of the cam plate $4f_1$, respectively, and the relative position of the driven rollers $4c_2$ is moved, thereby rotating shafts $4c_1$. Each of the pockets 4c is oscillated until it reaches a predetermined spacing across the delivery position P2 opposite a linear line against the pockets 3c of the winding wheel 3, i.e., at an angle corresponding to about the 1 o'clock position of applying wheel 4, in the preferred embodiment, to an angle corresponding to about the 2 o'clock position and then it is maintained on a linear line with the pockets 3c of winding wheel 3.

Thereafter, each of the pockets 4c is oscillated to a position where each of the pockets 4c reaches a predetermined spacing across the delivery position P3 opposing, on a linear line, a pocket 5a of the folding wheel 5, to be described later, i.e., and an angle corresponding to about the 8:30 o'clock position of applying wheel 4, in the preferred embodiment, and to an angle corresponding to about the 9:30 o'clock position and then each of the pockets 4c is maintained on a linear line with the pockets 4a of folding wheel 5.

In addition, the relative position of the driven rollers $4d_3$ is moved, thereby rotating shafts $4d_1$, with each of the pockets 4c reaching a predetermined spacing across the delivery position P2 opposing on a linear line the pockets 1 of tho winding wheel 3, i.e., an angle corresponding to about the 1 o'clock position of applying wheel 4 and moves toward an angle corresponding to about the 2 o'clock position, with pushers 4d being cooperatively operated in response to the projecting movement of the pushers 3c of the winding wheel 3 and moved down while being abutted against the inner surface A2 of the box-like item A to be transported. Thereafter, each of pockets 4c reaches a predetermined spacing across the delivery position P3 opposed on a linear line to the pockets 5 of the folding wheel 5, i.e., at an angle corresponding to about the 8 o'clock position of applying wheel 4 and moves toward an angle corresponding to about the 10 o'clock position and then the pushers 4d are activated.

The relative positions of the driven rollers $4e_5$, $4e_6$ are moved, whereby each of the hollow shafts $4e_3$ of the folding claws $4e_2$ and the rotating cylinders $4e_4$ of the folding pieces $4e_2$ is rotated. Each of the pockets 4c reaches a predetermined angle position, i.e., an angle corresponding to about the 1:30 o'clock position of applying wheel 4, in the preferred embodiment, and moves toward an angle corresponding to about the 2:30 o'clock position. Folding claws $4e_1$ are moved toward or away from, in a counterclockwise direction, an abutment against one free end B1 of the packaging sheet B and thereafter as wheel 4 is moved toward an angle corresponding to about the 3:30 o'clock position, the folding claws $4e_1$ are moved away in a clockwise direction.

Concurrently, after each of the pockets 4c reaches a predetermined angular position i.e., an angle corresponding to about the 1:30 o'clock position of applying wheel 4, in the preferred embodiment, it moves toward an angle corresponding to about the 3:30 o'clock position thereof. Folding pieces $4e_2$ are moved in clockwise direction while being delayed from a projecting speed of the folding claws $4e_1$, butted against the other free end B2 of the packaging sheet B and overlapped to the outside part of the one free end B1. Thereafter when wheel 4 reaches an angle corresponding to about the 6:00 o'clock position folding pieces $4e_2$ are moved away in a counterclockwise direction.

Then, folding pieces $4e_2$ are supported in a radial direction of applying wheel 4 through the supporting shafts $4e_2$ pivotally supported at outer circumferences of the rotating cylinders $4e_4$ in such a way that they may be projected out or moved down. Sealing heaters 4g are integrally and cooperatively disposed so as to form the heating surfaces $4g_1$ at portions of the folding pieces $4e_2$ opposing the outer surfaces A1 of box-like items A transported in pockets 4c. At the same time the driven rollers $4g_2$ are rotatably supported in opposition to the fixed cam $4f_6$ of the control cam 4f. A separating mechanism 4h is provided for separating the heating surfaces $4g_1$ from the outer surfaces A1 of box-like items A.

Fixed cam $4f_6$ of control cam 4f is formed in an arcuate shape in opposition of the driving shaft 4a. For the driven rollers $4g_2$ of the sealing heaters 4g, a resilient member $4g_3$, such as spring, is provided, for example, for always abutting the driven rollers $4g_2$ against fixed cam $4f_6$. Driven rollers $4g_2$ are moved along fixed cam $4f_6$ as the driving shaft 4a is rotated. Heating surfaces $4g_1$ are controlled in their positions, and the heating surfaces $4g_1$ are pushed against the outer surfaces A1 of the box-like items A through the overlapping portions B3 of packaging sheet B after each of pockets 4c reaches a predetermined angular position with an angle corresponding to about the 3:30 o'clock position of applying wheel 4 in the preferred embodiment and reaches an angle corresponding to about the 6:00 o'clock position.

Separating mechanism 4h is operated such that it pulls away the heater surfaces $4g_1$ from the overlapped portions B3 a specified period of time after the heater surfaces $4g_1$ are pushed against the overlapped portions B3 of the packaging sheet B without being related to the rotational speed of applying wheel 4. Separating mechanism 4h is comprised of a sensing part $4h_1$ for sensing a rotational speed of the applying wheel 4, a timer part $4h_2$ operated in response to signal outputted from the sensing part $4h_1$ and a separating part $4h_3$ operated when the timer part $4h_2$ is timed out.

In the preferred embodiment of the present invention, the sensing part $4h_1$ of the separating mechanism 4h is constructed such that the rotational speed of the driving shaft 4a is electrically sensed by a rotary encoder or the like, for example, and when this sensed value is less than a set speed, a signal is newly outputted to the timer part $4h_2$, the latter causing an air cylinder $4h_4$ to be extended concurrently with the starting of the pushing operation of the heater surfaces $4g_1$ in response to inputting of the signal. Moving cam $4h_5$, operatively arranged at the air cylinder $4h_4$, is projected toward the disk 4b of the applying wheel 4 and then only if air timer $4h_6$ is disposed in compliance with each of the heater surfaces $4g_1$ in the disk 4b where it starts to push against the outer surfaces A1 of the box-like items A after reaching the predetermined angular starting position.

Separating part $4h_3$ causes air cylinder $4h_7$ to be extended via air pressure when air timer $4h_6$ is started up. Oscillating pieces $4h_8$, supported for oscillating movement on supporting shafts $4e_7$, at the outer circumferences of rotating cylinders $4e_4$, are oscillated toward the direction engaging with the folding pieces $4e_2$ and the heater surfaces $4g_1$ are pulled away from the outer surfaces A1 of box-like items A.

Folding wheel 5 is placed near the downstream side of applying wheel 4 and is rotatably disposed in a vertical direction, having a plurality of inverse U-shaped pockets 5a, as viewed from their front surfaces into which the box-like items A are fitted at the outer circumferences. Twelve pockets, in the preferred embodiment, are equally spaced apart via a planetary gear mechanism. They are continuously rotated in a synchronous manner in a counterclockwise direction, as viewed from the front side in such a way that the rotational speeds of these pockets 5a are substantially the same as the rotational speeds of the pockets 4c of the applying wheel 4. Pockets 5a are rotated while their relative positions are kept in a horizontal plane regardless of the rotational position of folding wheel 5.

As shown in FIG. 1, a low speed conveyor 6, in partial contact with moving tracks of pockets 5*a*, and continuously and linearly moveable at a slower speed than a forwarding or retracting speed of each of the pockets 5*a*, together with a transferring passage 7, disposed in parallel with the low speed conveyor 6 and opposing against bottom surfaces A3 of the box-like items A, are arranged above the folding wheel 5, whereby box-like items A, fed in an arcuate path upwardly under a continuous rotation of the folding wheel 5 are held between the holding claws 6*a*, 6*a* of low speed conveyor 6. Box-like items A are pulled out of the pocket 5*a* from the rear and at the same time the projection 5*b* of the subsequent pocket 5 follows up to fold the rear flaps projecting from the right and left side surfaces A4, A4 of the box-like item A and subsequently the front flap as well as the upper and lower flaps are folded in sequence through the fixed-guide disposed on the transferring passage 7 and then thermally adhered to each other by the heater belt 8.

The operation of the packaging device, described above will now be described as follows.

Normally, the horizontal belt conveyors 1*b*, 1*b* positioned at an upstream side of transporting conveyor 1, and the outer circumferences $1e_1$, 1*e* of the feeding rollers 1*e*, 1*e* are driven at the same speed; the intermediate belt conveyors 1*c*, 1*c* and the outer circumferences $1f_1$, $1f_1$ of the feeding rollers 1*f*, 1*f* are driven at a speed faster than the speed of conveyors 1*b*, 1*b* and the downstream and side belt conveyors 1*d*, 1*d* are driven at a speed faster than the speed of conveyors 1*c*, 1*c*.

Figure 3:
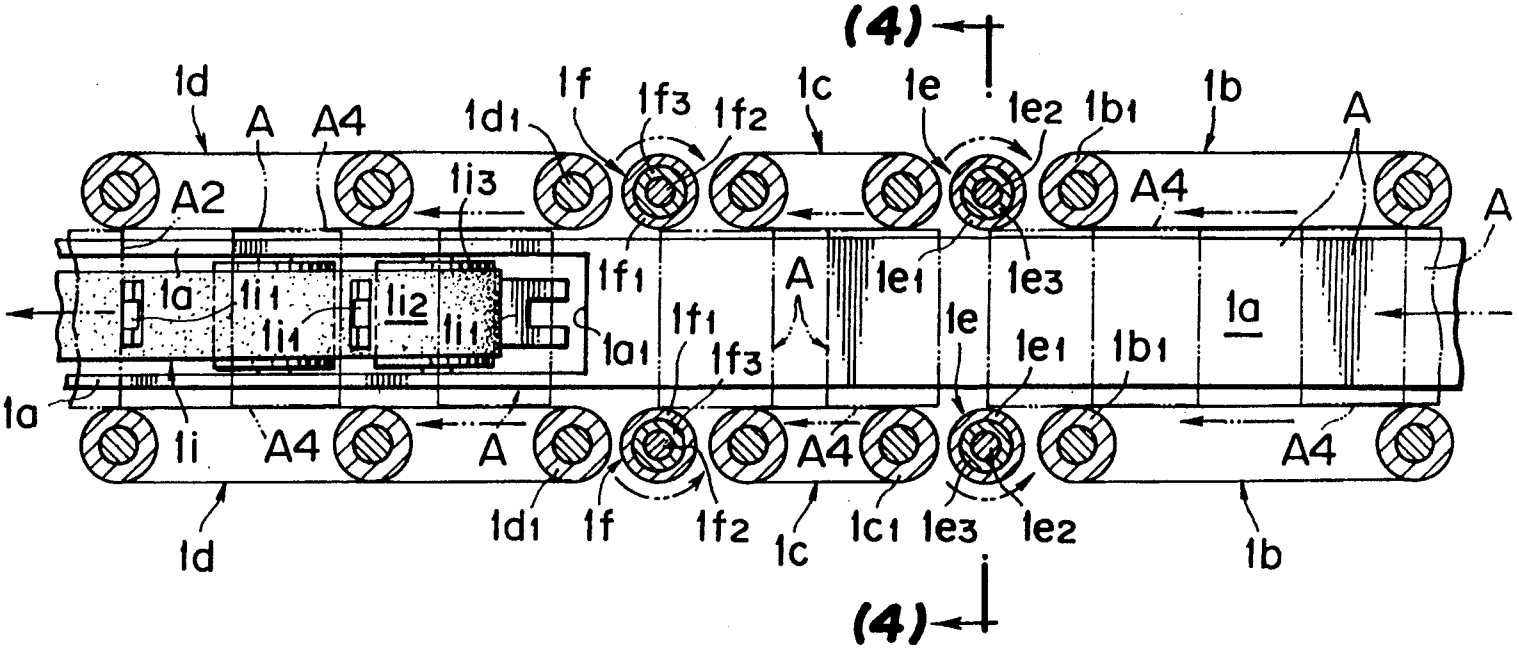
FIG. 3 is a top plan view in cross section of FIG. 2.
Figure 4:
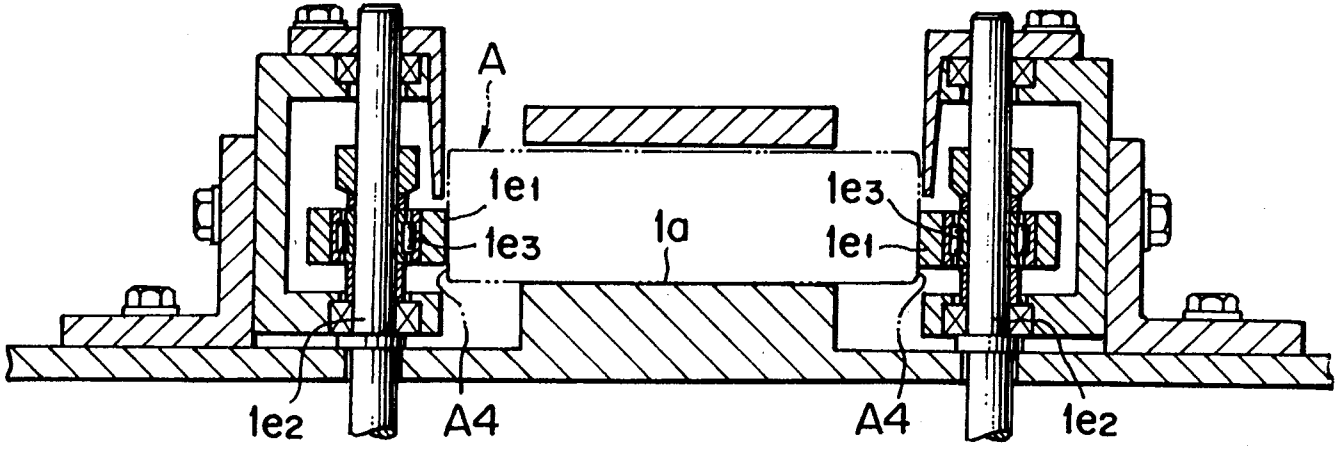
FIG. 4 is a partial enlarged side elevational view in longitudinal section taken along a line 4—4 of FIG. 3.

Under this condition, the box-like items A are supplied from the item supplying source onto the transferring passage 1*a* while being in contact with each other. As both side surfaces A4, A4 of these box-like items A are abutted against the upstream side belt conveyors 1*b*, 1*b*, box-like items A are transported to the feeding rollers 1*e*, 1*e* while being in contact with each other as shown in FIGS. 2 and 3. While being driven by upstream side belt conveyors 1*b*, 1*b*, results in both side surfaces A4, A4 of the transported box-like item A being abutted against the outer circumferences $1e_1$, $1e_1$ of the feeding rollers 1*e*, 1*e*. As shown in FIG. 4, box-like items A are fed out toward the downstream side, i.e., the intermediate belt conveyors 1*c*, 1*c* as a result of the rotation of the outer circumferences $1e_1$, $1e_1$ of rollers 1*e*, 1*e*.

Thereafter, as the front part of the box-like item A is abutted or received against the intermediate belt conveyors 1*c*, 1*c*, concurrently with an abutment of the rear part of the box-like item A against the outer circumferences $1e_1$, $1e_1$ of the feeding rollers 1*e*, 1*e*, box-like item A is accelerated toward a downstream side and pulled, because of the difference between the driving speeds of the outer circumferences $1e_1$, $1e_1$ of these feeding rollers 1*e*, 1*e*, and the driving speeds of the intermediate belt conveyors 1*c*, 1*c*, when the outer circumferences $1e_1$, $1e_1$ of the feeding rollers 1*e*, 1*e* are rotated idly in respect to the driving shafts $1e_2$, $1e_2$ due to the operation of one-way clutches $1e_3$, $1e_3$.

Accordingly, there occurs no slip between the rear part of the box-like item A and the outer circumferences $1e_1$, $1e_1$ of the feeding rollers 1*e*, 1*e* and subsequently the item is fed to the feeding rollers 1*f*, 1*f* under driving speed of the intermediate belt conveyors 1*c*, 1*c* and then a predetermined spacing is achieved between a box-like item A and a subsequent box-like item A.

Subsequently, as both side surfaces A4, A4 of the transported box-like item A are abutted against the outer circumferences $1f_1$, $1f_1$ of the feeding rollers 1*f*, 1*f*, under the driving operation of the intermediate belt conveyors 1*c*, 1*c*, item A is fed out toward the downstream side belt conveyors 1*d*, 1*d* as these feed roller outer circumferences $1f_1$, $1f_1$ are rotated.

Then, as the front side of the box-like item A is abutted against the downstream side belt conveyors 1*d*, 1*d*, concurrently with the time during which the rear part of the box-like item A is abutted against the outer circumferences $1f_1$, $1f_1$, of the feeding rollers 1*f*, 1*f*, box-like item A is accelerated toward the downstream side and pulled under a relative speed difference between the outer circumferences $1f_1$, $1f_1$ of feeding rollers 1*f*, 1*f* and the downstream side belt conveyors 1*d*, 1*d*, whereby the outer circumferences $1f_1$, $1f_1$ of the feeding rollers 1*f*, 1*f* are rotated idly with respect to the driving shafts $1f_2$, $1f_2$ due to the operation of one-way clutches $1f_3$, $1f_3$.

Accordingly, there occurs no slip between the rear part of the box-like item A and the outer circumferences $1f_1$, 1*f* of the feeding rollers 1*f*, 1*f*, and subsequently item A is transported toward the pusher conveyor 1*i* at a driving speed of the downstream side belt conveyors 1*d*, 1*d* and the spacing between a box-like item A and its subsequently box-like item A is opened further.

After this operation, the pusher plates $1i_1$ of the pusher conveyor 1*i* are raised substantially into a vertical position, projecting out above the transferring passage 1*a*. Pusher plates $1i_1$ advance into the clearance between each of the box-like items A and are abutted against the rear surface A2 of each of the box-like items A, whereby each of the pusher plates $1i_1$ is abutted against the box-like item A with more force when it is moved into the spacing between the box-like items A compared to the case where the pusher plates $1i_1$ are gradually raised from their slanted state or position and projected onto the transferring passage 1*a*. Even if the spacing between subsequent box-like items A is short, the pusher plates $1i_1$ can be positively advanced and subsequently the box-like items A are transported while they are being equally spaced apart by the pusher plates $1i_1$.

Thus, as shown in FIG. 5, each of the holding claws 2*g* is rotated via rotation of the transferring wheel 2, and as claws 2*g* move from the upper limit position of the transferring wheel 2 toward the downstream end of each of the transferring passages 1*a*, 1*a*, spaced apart from the transporting conveyor 1 in a rightward or leftward direction, the mounting surfaces $2g_1$, $2g_1$ are oscillated in a counter-transporting direction around an upper end of the holding claw 2*g* via the operation of the control cam 2*j* and the claw 2*g* is moved between the box-like items A on the transferring passages 1*a*, 1*a* while being inclined.

After this operation, as item A approaches transferring passages 1*a*, 1*a*, mounting surfaces $2g_1$, $2g_1$ are oscillated around the upper end of the holding claw 2*g* in a transporting direction under the operation of the control cam 2*j* and abutted against the bottom surface A3 of the box-like item A while being in a horizontal state. Box-like item A is held between the mounting surfaces $2g_1$, $2g_1$ and the holding guide 2*i* and temporarily fixed and item A is picked up on the mounting surfaces $2g_1$, $2g_1$ under a continuous rotation of the subsequent transferring wheel 2 and then item A is transferred upwardly while being kept in a horizontal state.

Thus, as box-like item A, placed on the mounting surfaces $2g_1$, $2g_1$, reaches a place near the delivery position P1 and occupies a linear line, pockets 3*c* of the winding wheel 3 and pushers 2*h* are aligned and the latter are projected and moved under the operation of the control cam 2*j*. Box-like item A, held between the mounting surfaces $2g_1$, $2_{g1}$ and the holding guide 2*i*, is pushed out and then delivered into the pocket 3*c*.

Figure 12:
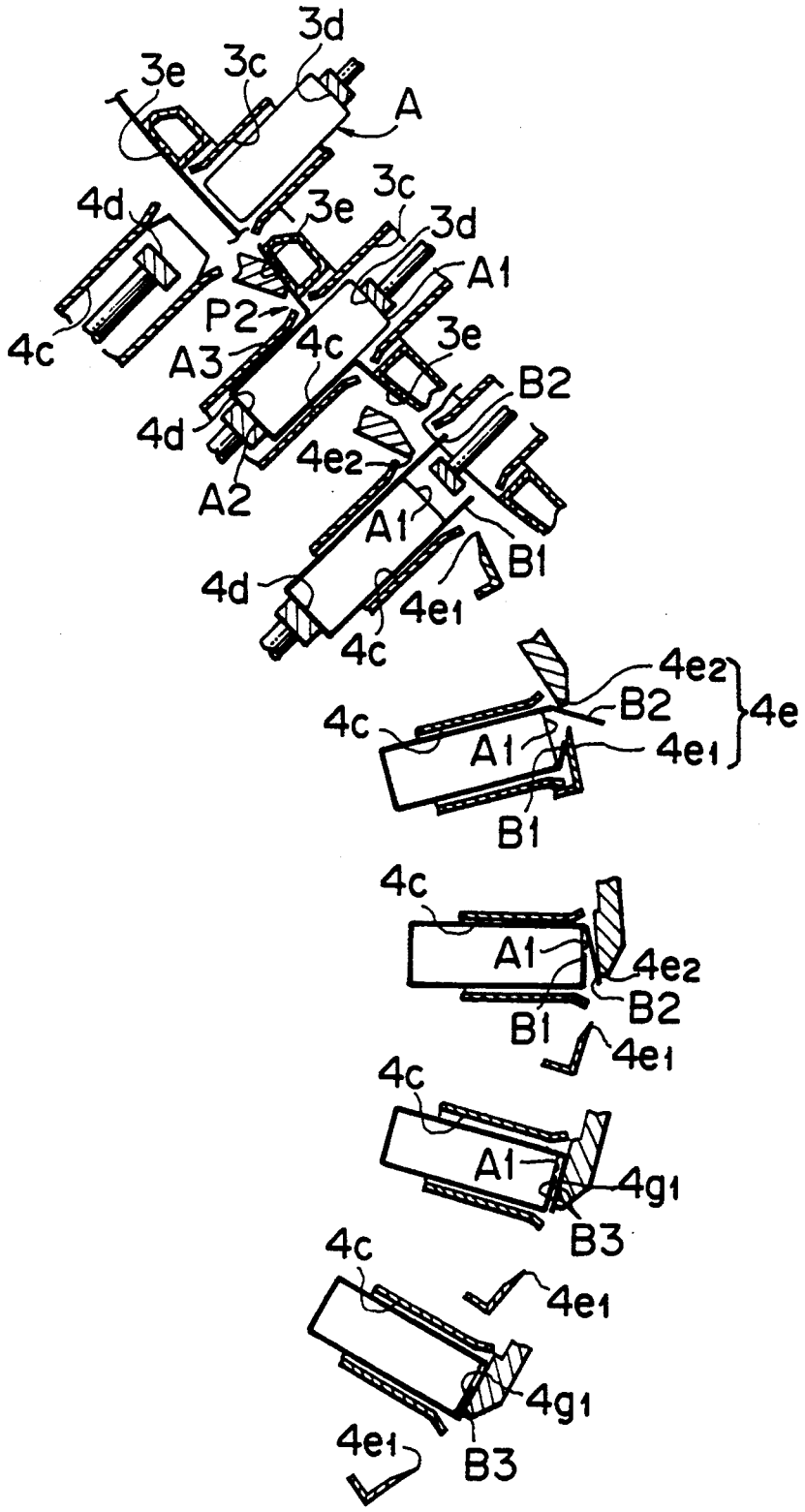
FIG. 12 is a partial enlarged front elevational view in longitudinal section for showing an operating sequence of a folding mechanism.

After this operation, box-like item A within each of the pockets 3*c* is transferred in an arcuate path under a continuous rotation of the winding wheel 3 and reaches near the sheet supplying mechanism 3*f*, resulting in that the packaging sheet B, supplied from the sheet supplying mechanism 3*f*, is held so as to cover the opening of the pocket 3*c*. Box-like item A and the packaging sheet B are transferred in an arcuate path and they reach a position near the delivery position P2 and occupy a linear line, in alignment with the pocket 4*c* of applying wheel 4, resulting in that as shown in FIG. 12, the pusher 3*d* is projected out under the operation of control cam 3*g* and the box-like item A is pushed out of the pocket 3*c* into the pocket 4*c* of applying wheel 4.

In this case, pusher 4*d* of applying wheel 4 is moved downwardly while being abutted at the central part of the packaging sheet B adhering against the inner surface A2 of the box-like item A being transported into the pocket 4*d* under the operation of control cam 4*f*. Thereafter, box-like item A is delivered while it is being held in forward or a rearward direction.

With such an arrangement, as noted above, the packaging sheet B is struck against the opening edge of the pocket 4*c* and both free ends B1, B2 of the packaging sheet B are projected out of the pocket 12 in an outward direction concurrently with the folding of box-like item A into a U-shape along the upper and lower surfaces A3, A4.

Also subsequently, the pocket 4*c*, having the box-like item A and the packaging sheet B received therein, is transferred in an arcuate path under a continuous rotation of applying wheel 4. Folding claw $4e_1$ of folding mechanism 4*e* is moved to pocket 4*c* via the operation of the control cam 4*f* to cause one free end B1 of the packaging sheet B to the folded along the outer surface A1 of the box-like item A. Folding piece $4e_2$, is moved slightly toward pocket 4*c* in a delayed manner while the other free end B2 of the packaging sheet B is folded along the outer surface A1 of the box-like item A and overlaps the one free end B1. At the same time, heater surface $4g_1$, of the sealing heater 4*g*, is pushed against the overlapped portions B3 and the overlapped portions B3 are thermally adhered to each other.

In the event that the rotational speed of applying wheel 4 is more than the set speed at this time, the separating mechanism 4*h* is not operated, but when the heater surface $4g_1$ reaches a predetermined angular position, under an operation of the control cam 4*f*, it is moved away from the overlapped portions B3.

Figure 13:
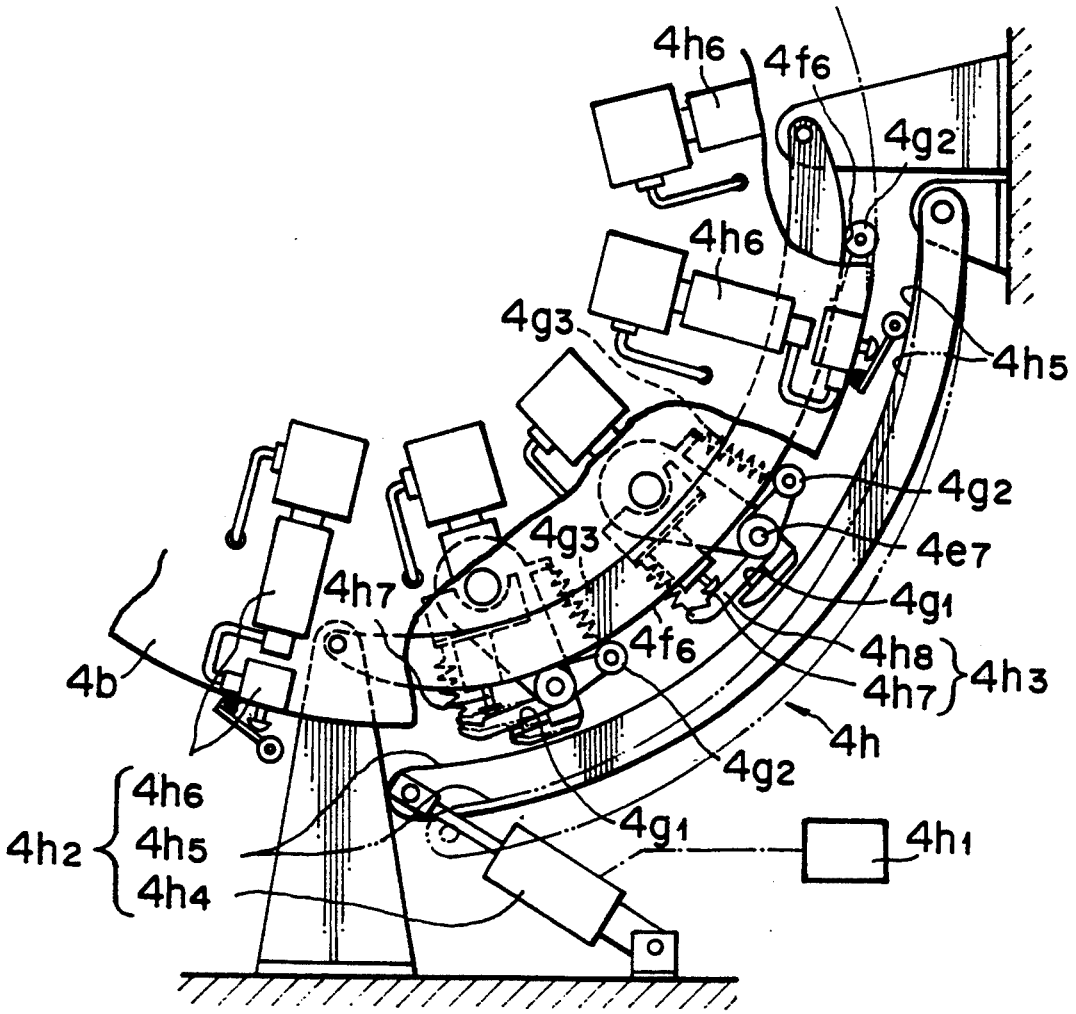
FIG. 13 is a front elevational view for showing an operating sequence of a separating mechanism, the figure being partially enlarged and partially broken away.

In addition, in the event that the rotational speed of applying wheel 4 at this time is less then the-set speed, the heater surface $4g_1$ is moved away from wheel 4 at a time before the heater surface $4g_1$ reaches the separating position via the operation of control cam 4*f*. FIG. 13 shows that after a specified period of time elapses, the separating mechanism 4*h* is operated to start to push the heater surface $4g_1$ against the overlapping portions B3.

After this operation, as pocket 4*c* arrives near the delivering position P3 and occupies a linear line with the pocket 5*a* of the folding wheel 5, pusher 4*d* is projected out via the operation of control cam 4f as shown in FIG. 1. Box-like item A, which is covered with packaging film B is delivered from within the pocket 4*c* toward the pocket 5*a* of the folding wheel 5 and subsequently each of the flaps projecting from the right and left side surfaces of the box-like item A is folded along the side surfaces and thermally adhered to each other.

In the aforesaid preferred embodiment, although the packaged cigarettes, continuously supplied for every equal-spaced apart relation by the transporting conveyor 1, are picked up one by one as box-like items A, by the transferring wheel 2, box-like items A are transferred in an arcuate path upwardly, while being kept at a horizontal state, and each of the box-like items A is transported from the transferring wheel 2 into the pockets 3*c* of the winding wheel 3. The present invention is not limited to this preferred embodiment and the packaged cigarettes A may be directly transported into the pockets 3*c* of the winding wheel 3 from the packaging machine at a previous stage and further the box-like items A may be products, other than packaged cigarettes.

In addition, the configuration comprising the separating and supplying part of the transporting conveyor 1; and the control cam 2*j* of the transferring wheel 2; the holding mechanism 3*e* of the winding wheel 3; the sheet supplying mechanism 3*f*; the control cam 3*g*; the folding mechanism 4*e* of applying wheel 4; the control cam 4*f*; the separating mechanism 4*h*; and the subsequent stages, at the downstream side from applying wheel 4, are not limited to the aforesaid structures. For example, at the separating and supplying part of the transporting conveyor 1, either two sets or four sets or more of the parallel belt conveyors opposing against the right and left side surfaces A4, A4 of the box-like items A may be laterally disposed in a linear manner and further a plurality of sets of parallel belt conveyors opposing against the upper and lower surfaces of the box-like item A may be laterally disposed in a linear line in operation similar to the present system.

The present invention is constructed to have the configuration as described above and has the following advantages:

The box-like items transported into each of the pockets under a continuous rotation of the winding wheel, are transferred in an arcuate path, and the packaging sheet supplied from the sheet supplying mechanism is held by the folding mechanism so as to cover the openings of the pockets during this arcuate transferring operation. Thereafter, the pockets reach a portion near the delivering position and each of the pockets of the winding wheel and the pockets of the opposing applying wheel is oscillated and thereby both these pockets are maintained on a linear line and at the same time the pushers are projected to deliver the box-like items into the pockets in the applying wheel, resulting in that the compact applying wheel, capable of being operated at a high speed, can be disposed at the downstream side of the winding wheel.

Accordingly, as compared with the prior art system in which an annular chain conveyor is curved over a predetermined segment of the outer circumference of the winding wheel and the annular heater belt is wound in an annular form over a predetermined segment at the outside part of the chain conveyor, the diameter of the applying wheel positioned at the downstream side is not increased more than the diameter of the winding wheel, resulting in that the entire device can be made small and the winding wheel can be rotated at high speed and the processing speed enables a large amount of packaging to be carried out within a short period of time.

Each of the pockets of the applying wheel is provided with a folding mechanism for folding both free ends of the packaging sheet, projecting out of the pockets along the outer surface of the box-like item. The sealing heater is in contact with the overlapped portions of the folded packaging sheet adheres them, resulting in that the entire device can be made compact as compared with that of the prior art system in which the heater belt is annularly projected and disposed.

Each of the pockets having the box-like items transported therein, as the applying wheel is continuously rotated, is transferred in an arcuate path. The folding mechanism and the sealing heater are operated when the pockets reach predetermined angular positions, whereby both free ends of the packaging sheet, projecting outwardly from the pockets, are folded along the outer surface of the box-like item and overlapped with each other. The free-ends are in contact with the sealing heater and the sealing heater is in contact with the overlapped packaging sheet portions only for a specified period of time via operation of the separating mechanism resulting in that the contact time between the overlapped portions and the sealing heater can be kept constant without having any relation with the variation in rotational speed of the winding wheel.

Accordingly, as compared with the prior art system, in which the contact time between the overlapped portions and the heater belt is proportional with the moving speed of the chain conveyor, no seizure occurs even if the rotational speed of the winding wheel is slower than its normal rotational speed during an energization of the device or at a low speed operation, for example. In addition, the contact time between the overlapped portions and the sealing heater can be adapted for the speed difference even if the rotational speed of the winding wheel is increased.

We claim:

1. A packaging device for packaging continuously transferred, transported and delivered box-like items with a thermoplastic packaging sheet, where the packaging sheet is wound in a U-shape along the surface of a box-like item, said packaging sheet having two projecting free ends, with said two free ends being adapted to be folded along an outer surface of the box-like item, said two free ends thereafter being overlapped, relative to each other, prior to being adhered to each other, said packaging device comprising:

a continuously rotatable winding wheel, having an axis and an outer circumferential portion, said outer circumferential portion having a plurality of evenly spaced first pockets, each of said first pockets transporting one of said box-like items, each of said first pockets having a circumferentially-directed opening;

means for supplying said packaging sheet directly to the outer circumferential portion of said winding wheel;

means for temporarily holding said packaging sheet around the circumferentially-directed opening of each of said first pockets;

a continuously rotatable applying wheel, having an axis and an outer circumferential portion, said outer circumferential portion having a plurality of evenly-spaced second pockets, each of said second pockets transporting said box-like items, each of said second pockets having a circumferentially-directed opening;

said applying wheel being continuously and synchronously rotatable with, and in the direction opposite to, the direction of rotation of said winding wheel;

said axis of said applying wheel being disposed in parallel and on a downstream side of said axis of said winding wheel;

said first and second pockets being evenly spaced apart in a rotational direction, and means for oscillatory moving said first and second pockets;

at least one of said pluralities of first and second pockets being adapted to be linearly aligned with each other over a predetermined segment thereby defining a predetermined position where said at least one of said pluralities of first and second pockets are opposite to each other in a linear line with a predetermined space between a respective first and second pocket;

a first pusher in a first pocket in said winding wheel, for pushing and transferring the box-like items, in said at least one of said first pockets through said space and into said at least one of said second pockets in a radial direction of said winding wheel along a line between said axis of said winding wheel and said axis of said applying wheel, a second pusher in a second pocket in said applying wheel, said second pusher contacting a box-like item and retracting when the box-like item is pushed by said first pusher, said box-like item being held between said first and second pushers, said first and second pushers permitting said packaging sheet to be wound in said U-shape along the surface of said box-like item;

a continuously rotatable transferring wheel rotating synchronously with and in the direction opposite to the rotating direction of said winding wheel, said transferring wheel being disposed in parallel with and on an upstream side of said winding wheel, said transferring wheel having an outer circumferential portion, said outer circumferential portion being provided with an oscillatory mounting surface adapted for picking up said box-like items;

a transporting conveyor located at a lower portion of said transferring wheel, said transporting conveyor having a plurality of evenly-spaced pushers, said pushers being outwardly projected for pushing said box-like items onto said mounting surface of said transferring wheel;

said transporting conveyor continuously supplying said box-like items to said transferring wheel in an equally-spaced apart manner;

wherein each of said mounting surfaces of said transferring wheel oscillates as each of said mounting surfaces approaches said transporting conveyor, said transporting conveyor including transferring passages, said mounting surfaces being oscillated in an opposite direction when said mounting surfaces pass through said transferring passages of said transporting conveyor, said mounting surfaces being kept horizontal until said mounting surfaces reach a delivery position with said first pocket of said winding wheel;

a control cam for simultaneously moving said means for transferring said box-like items when each of said mounting surfaces reaches said delivery position; and a separating and supplying mechanism for increasing the driving speed of said transporting conveyor in the downstream portion starting in a middle portion of said transporting conveyor, relative to the driving speed at an upstream portion of said transporting conveyor thereby spacing said box-like items, supplied by the upstream side of said transporting conveyor in a contacting relationship with each other, and thereafter feeding them in said downstream portion in an equally spaced apart relation.

2. The packaging device of claim 1, wherein said winding wheel includes means for oscillating said at least one of said first pockets when said first and second pockets reach a predetermined angular position; and means for controlling said means for transferring.

3. The packaging device of claim 2, wherein said means for controlling is a control cam.

4. The packaging device of claim 1, wherein said two free ends of said packaging sheet project out of said second pocket, said applying wheel including a folding mechanism for folding both of said free ends of said packaging sheet along said outer surface of said box-like items into overlapping portions; and a sealing heater on said folding mechanism adapted to contact said overlapped portions for thermally adhering said overlapped portions to each other.

5. The packaging device of claim 1 including a transferring roller, said roller abutting against the box-like items being transported, said roller being rotatably supported and located between said upstream portion and said downstream portion of said separating and supplying mechanism; a driving shaft; a one-way clutch, connected with said driving shaft and said roller, for transmitting rotation of said driving shaft in the transporting direction of said box-like items, said rotation being transmitted to an outer circumference of said roller, said one-way clutch being disposed between the outer circumference of the transferring roller and said driving shaft, with said driving shaft passing through the center of said roller, with the outer circumference of said roller being rotated at the driving speed of the upstream portion of said transporting conveyor, said rotation being transmitted from the driving shaft toward the outer circumference of said roller via said one-way clutch.

6. A packaging device for packaging box-like items with a thermoplastic packaging sheet supplied thereto where the packaging sheet is wound in a U-shape along the surface of each box-like item while said box-like item is continuously transported, transferred and delivered, said packaging sheet having two projected free ends, with said two free ends being adapted to be folded along the surface of the box-like item, said two free ends being adapted to be overlapped to each other and then adhered to each other, said packaging device comprising:

a continuously rotatable winding wheel, having an axis and an outer circumferential portion, said outer circumferential portion having a plurality of evenly spaced first open pockets;

said thermoplastic sheet being supplied to the outer circumferential portion of said winding wheel;

means for temporarily holding said thermoplastic sheet around a circumferentially-directed opening of each of said first pockets;

a continuously rotatable applying wheel, having an axis and an outer circumferential portion, said outer circumferential portion having a plurality of evenly-spaced second open pockets;

said axis of said applying wheel being disposed close to and in parallel with said axis of said winding wheel;

said winding wheel and said applying wheel being continuously and synchronously rotatable in opposite direction from each other;

said first and second pockets being equally spaced apart in a circumferential direction, each of said pockets transporting one of said box-like items therein;

a first pusher in said first pocket for pushing and transferring one of said box-like items from said first pocket into said second pocket in a radial direction of said winding wheel along a line between said axis of said winding wheel and said axis of said applying wheel, a second pusher in a second pocket in said applying wheel, said second pusher contacting a box-like item and retracting when the box-like item is pushed by said first pusher, said box-like item being held between said first and second pushers, whereby, during said transferring operation from said first pocket to said second pocket, said packaging sheet is wound in a U-shape along the surface of said box-like items;

said two free ends of said packaging sheets projecting out of said second pockets;

a folding mechanism on a respective said second pocket for folding both of said free ends of said packaging sheet along said outer surface of said box-like items into overlapped portions;

means for heat sealing said overlapped portions of said packaging sheet on a respective said second pocket for thermally adhering said overlapped portions to each other;

a separating mechanism for separating said means for heat sealing from said overlapped portions of said packaging sheet after a predetermined period of time after contact between said means for heat sealing and said overlapped portions;

a continuously rotatable transferring wheel rotating synchronously with and in the direction opposite to the rotating direction of said winding wheel, said transferring wheel being disposed in parallel with and on an upstream side of said winding wheel, said transferring wheel having an outer circumferential portion, said outer circumferential portion being provided with an oscillatory mounting surface adapted for picking up said box-like items;

a transporting conveyor located at a lower portion of said transferring wheel, said transporting conveyor having a plurality of evenly,spaced pushers, said pushers being outwardly projected for pushing said box-like items onto said mounting surface of said transferring wheel;

said transporting conveyor continuously supplying said box-like items to said transferring wheel in an equally-spaced apart manner;

wherein each of said mounting surfaces of said transferring wheel oscillates as each of said mounting surfaces approaches said transporting conveyor, said transporting conveyor including transferring passages, said mounting surfaces being oscillated in an opposite direction when said mounting surfaces pass through said transferring passages of said transporting conveyor, said mounting surfaces being kept horizontal until said mounting surfaces reach a delivery position with said first pocket of said winding wheel;

a control cam for simultaneously moving out or moving down said means for transferring said box-like items when each of said mounting surfaces reaches said delivery positions, and a separating and supplying mechanism for increasing the driving speed of said transporting conveyor in the downstream portion starting in a middle portion of said transporting conveyor, relative to the driving speed at an upstream portion of said transporting conveyor thereby spacing said box-like items, supplied by the upstream side of said transporting conveyor in a contacting relationship with each other, and thereafter feeding them in said downstream portion in an equally spaced apart relation.

7. The packaging device of claim 6 wherein said folding mechanism comprises folding claws and folding pieces, said means for heat sealing being on and forming a portion of said folding pieces, said folding claws and folding pieces being disposed in opposition to the outer surface of said box-like items in a manner to permit movement toward and away from each other, said folding claws being adapted to move forward and away from said box-like items when each of said second pockets, in said applying wheel, reaches a predetermined angular position; and means for controlling said folding pieces including controlling the movement toward and away from said outer surface of said box-like items, delaying such movement, and separating said folding pieces therefrom.

8. The packaging device of claim 6 including a transferring roller, said roller abutting against the box-like items being transported, said roller being rotatably supported and located between said upstream portion and said downstream portion of said separating and supplying mechanism; a driving shaft; a one-way clutch, connected with said driving shaft and said roller, for transmitting rotation of said driving shaft in the transporting direction of said box-like items, said rotation being transmitted to an outer circumference of said roller, said one-way clutch being disposed between the outer circumference of the transferring roller and said driving shaft, with said driving shaft passing through the center of said roller, with the outer circumference of said roller being rotated at the driving speed of the upstream portion of said transporting conveyor, said rotation being transmitted from the driving shaft toward the outer circumference of said roller via said one-way clutch.

9. The packaging device of claim 1, wherein said axis of said applying wheel is also spaced from said axis of said winding wheel in a vertical direction.

10. The packaging device of claim 9, wherein said axis of said applying wheel is located at a downward angle of 45° from said axis of said winding wheel.

11. The packaging device of claim 6, wherein said axis of said applying wheel is also spaced from said axis of said winding wheel in a vertical direction.

12. The packaging device of claim 11, wherein said axis of said applying wheel is located at a downward angle of 45° from said axis of said winding wheel.

* * * * *

UNITED STATES PATENT AND TRADEMARK OFFICE

CERTIFICATE OF CORRECTION

PATENT NO. : 5,442,894
DATED : August 22, 1995
INVENTOR(S) : T. OGATA et al.

It is certified that error appears in the above-indentified patent and that said Letters Patent is hereby corrected as shown below:

At column 19, line 64 after "supplied" insert ---directly---.

At column 20, line 55 change "evenly,spaced" to ---evenly-spaced---.

At column 21, line 8 change "positions," to ---positions;---.

Signed and Sealed this

Twelfth Day of November, 1996

*Attest:*

*Attesting Officer*

BRUCE LEHMAN

*Commissioner of Patents and Trademarks*